US011420098B2

(12) United States Patent
Honea et al.

(10) Patent No.: US 11,420,098 B2
(45) **Date of Patent: *Aug. 23, 2022**

(54) IRON TYPE GOLF CLUB HEAD AND SET

(71) Applicant: Taylor Made Golf Company, Inc., Carlsbad, CA (US)

(72) Inventors: Justin Honea, Richardson, TX (US); John Kendall, Wylie, TX (US); Matthew Brian Neeley, Dallas, TX (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/145,866

(22) Filed: Jan. 11, 2021

(65) Prior Publication Data

US 2021/0128992 A1 May 6, 2021

Related U.S. Application Data

(60) Continuation of application No. 16/524,240, filed on Jul. 29, 2019, now Pat. No. 10,888,749, which is a continuation of application No. 15/794,473, filed on Oct. 26, 2017, now Pat. No. 10,398,950, which is a division of application No. 13/842,545, filed on Mar. 15, 2013, now Pat. No. 9,802,089.

(51) Int. Cl.

| | |
|---|---|
| ***A63B 53/00*** | (2015.01) |
| ***A63B 53/04*** | (2015.01) |
| ***A63B 60/54*** | (2015.01) |

(52) U.S. Cl.

CPC ..... *A63B 53/047* (2013.01); *A63B 53/0475* (2013.01); *A63B 60/54* (2015.10); *A63B 53/0433* (2020.08); *A63B 2053/0491* (2013.01)

(58) Field of Classification Search

CPC ..... A63B 53/0475; A63B 53/047; A63B 2053/0005

See application file for complete search history.

(56) References Cited

U.S. PATENT DOCUMENTS

| | | | |
|---|---|---|---|
| 550,976 | A | 12/1895 | Jennings |
| 632,885 | A | 9/1899 | Sweny |
| 819,900 | A | 5/1906 | Martin |
| 1,154,490 | A | 9/1915 | Davis |
| 1,541,126 | A | 6/1925 | Dunn |
| 1,705,997 | A | 3/1929 | Quynn |
| 1,835,718 | A | 12/1931 | Morton |
| 1,854,548 | A | 4/1932 | Hunt |

(Continued)

FOREIGN PATENT DOCUMENTS

| | | | |
|---|---|---|---|
| CA | 2145832 | C | 11/1995 |
| GB | 155632 | A | 10/1936 |

(Continued)

OTHER PUBLICATIONS

Ralph Maltby, Golf Club Design, Fitting, Alteration, & Repair, 1995, Ralph Maltby Enterprises, 4th Edition, 220.*

*Primary Examiner* — Eugene L Kim
*Assistant Examiner* — Matthew B Stanczak
(74) *Attorney, Agent, or Firm* — Dawsey Co., LPA; David J. Dawsey

(57) ABSTRACT

An iron-type golf club head and set having a passageway extending from a closed void behind the face and accessible from an exterior of the body.

19 Claims, 12 Drawing Sheets

(56) References Cited

U.S. PATENT DOCUMENTS 2,429,351 A 10/1947 Fetterolf
3,035,480 A 5/1962 Teucher
3,061,310 A 10/1962 Giza
3,079,157 A 2/1963 Turner
3,084,940 A 4/1963 Cissel
3,138,386 A 6/1964 Onions
3,166,320 A 1/1965 Onions
D207,227 S 3/1967 Solheim
D209,301 S 11/1967 Comitz
D212,890 S 12/1968 Rose
D218,178 S 7/1970 Solheim
3,556,532 A 1/1971 Ballmer
3,578,332 A 5/1971 Caldwell
3,679,207 A 7/1972 Florian
3,810,631 A 5/1974 Braly
3,862,759 A 1/1975 Evans et al.
3,923,308 A 12/1975 Mills
3,970,236 A 7/1976 Rogers
3,989,248 A 11/1976 Campau
3,995,865 A 12/1976 Cochran et al.
4,027,885 A * 6/1977 Rogers ..... A63B 53/04 473/342
4,043,562 A 8/1977 Shillington
D246,329 S 11/1977 Little
4,123,056 A 10/1978 Nakamatsu
D256,264 S 8/1980 Solheim
4,252,262 A 2/1981 Igarashi
D260,160 S 8/1981 Giebel
4,322,083 A 3/1982 Imai
D264,488 S 5/1982 Kobayashi
4,340,230 A 7/1982 Churchward
4,398,965 A 8/1983 Campau
4,420,156 A * 12/1983 Campau ..... A63B 60/00 473/291
4,523,759 A 6/1985 Igarashi
4,630,825 A * 12/1986 Schmidt ..... A63B 53/047 164/35
4,687,205 A 8/1987 Tominaga et al.
1,294,850 A 3/1988 Simmons
4,836,550 A 6/1989 Kobayashi
D306,195 S 2/1990 MacNally et al.
D306,334 S 2/1990 Alcala
D310,115 S 8/1990 Iinuma
D310,699 S 9/1990 Parente et al.
4,979,744 A 12/1990 Alcala
D314,803 S 2/1991 Antonious
D315,588 S 3/1991 Antonious
5,024,437 A 6/1991 Anderson
D319,091 S 8/1991 Antonious
D319,858 S 9/1991 Antonious
D320,056 S 9/1991 Antonious
5,050,879 A * 9/1991 Sun ..... A63B 53/047 473/338
5,056,788 A 10/1991 Katayama
5,094,383 A 3/1992 Anderson et al.
D327,520 S 6/1992 Antonious
D327,720 S 7/1992 Antonious
D328,116 S 7/1992 Antonious
D328,322 S 7/1992 Antonious
D328,482 S 8/1992 Antonious
D328,483 S 8/1992 Antonious
D329,904 S 9/1992 Gorman
D330,241 S 10/1992 Antonious
D331,088 S 11/1992 Antonious
D331,272 S 11/1992 Antonious
5,160,136 A * 11/1992 Eger ..... A63B 60/00 D21/748
5,160,144 A 11/1992 Maniatis
D332,478 S 1/1993 Antonious
D334,959 S 4/1993 Iinuma et al.
5,242,167 A 9/1993 Antonious
5,255,918 A 10/1993 Anderson et al.
5,261,663 A 11/1993 Anderson
5,282,625 A 2/1994 Schmidt et al.
5,301,946 A 4/1994 Schmidt et al.
5,316,298 A 5/1994 Hutin et al.
5,330,187 A 7/1994 Schmidt et al.
5,344,140 A 9/1994 Anderson
5,344,150 A 9/1994 Schmidt et al.
5,346,219 A 9/1994 Pehoski et al.
D351,644 S 10/1994 Jensen
D353,644 S 12/1994 Hirsch et al.
5,388,826 A 2/1995 Sherwood
5,409,229 A 4/1995 Schmidt et al.
5,419,556 A 5/1995 Take
D360,008 S 7/1995 Solheim
D360,445 S 7/1995 Schmidt et al.
D360,925 S 8/1995 Antonious
5,437,456 A 8/1995 Schmidt et al.
5,441,264 A 8/1995 Schmidt et al.
D362,041 S 9/1995 Takahashi et al.
D362,481 S 9/1995 Takahashi et al.
5,460,377 A 10/1995 Schmidt et al.
5,464,218 A 11/1995 Schmidt et al.
5,472,203 A 12/1995 Schmidt et al.
5,480,145 A 1/1996 Sherwood
5,485,997 A 1/1996 Schmidt et al.
5,492,327 A 2/1996 Biafore
5,524,331 A 6/1996 Pond
5,529,543 A * 6/1996 Beaumont, Sr. ..... A63B 60/00 473/332
5,533,728 A 7/1996 Pehoski et al.
D373,161 S 8/1996 Schmidt et al.
5,547,194 A 8/1996 Aizawa et al.
5,564,705 A 10/1996 Kobayashi et al.
5,588,922 A 12/1996 Schmidt et al.
5,588,923 A 12/1996 Schmidt et al.
D377,381 S 1/1997 Takahashi et al.
D378,112 S 2/1997 Salonica
5,603,668 A 2/1997 Antonious
5,605,510 A 2/1997 Schmidt et al.
5,605,511 A 2/1997 Schmidt et al.
D379,393 S 5/1997 Kubica et al.
D379,485 S 5/1997 Ragano
5,626,530 A 5/1997 Schmidt et al.
D381,726 S 7/1997 Sugo
5,643,106 A 7/1997 Baird
D383,819 S 9/1997 Takahashi et al.
D383,820 S 9/1997 Watanabe
5,665,009 A 9/1997 Sherwood
D386,550 S 11/1997 Wright et al.
D386,551 S 11/1997 Solheim et al.
5,704,849 A 1/1998 Schmidt et al.
5,743,813 A 4/1998 Chen et al.
5,749,795 A 5/1998 Schmidt et al.
5,766,092 A 6/1998 Mimeur et al.
5,772,527 A * 6/1998 Liu ..... A63B 60/00 473/409
D400,943 S 11/1998 Ezaki
D400,945 S 11/1998 Gilbert et al.
D402,326 S 12/1998 Moore
D406,296 S 3/1999 Rollinson et al.
D406,869 S 3/1999 Rollinson et al.
5,899,820 A 5/1999 Minematsu et al.
5,899,821 A 5/1999 Hsu et al.
D410,514 S 6/1999 Takahashi et al.
D410,719 S 6/1999 Rollinson et al.
D413,951 S 9/1999 Storer et al.
D418,887 S 1/2000 Williams
D421,635 S 3/2000 Whitley
6,042,486 A * 3/2000 Gallagher ..... A63B 53/0475 473/332
6,045,456 A 4/2000 Best et al.
6,077,171 A 6/2000 Yoneyama
D428,634 S 7/2000 Nagai et al.
D428,635 S 7/2000 Nagai et al.
6,086,485 A 7/2000 Hamada et al.
6,093,112 A * 7/2000 Peters ..... A63B 53/047 473/291
D429,299 S 8/2000 Kubica et al.
D435,278 S 12/2000 Reed et al.
6,179,726 B1 1/2001 Satoh et al.
6,196,934 B1 3/2001 Sherwood

(56) References Cited

U.S. PATENT DOCUMENTS

D442,043 S 5/2001 Kao
D442,659 S 5/2001 Kubica et al.
D444,195 S 6/2001 Wahl et al.
D445,157 S 7/2001 Jones et al.
6,290,607 B1 9/2001 Gilbert et al.
6,290,609 B1 9/2001 Fakeda
6,344,000 B1 2/2002 Hamada et al.
6,344,001 B1 2/2002 Hamada et al.
D454,932 S 3/2002 Mahaffey et al.
6,368,232 B1 4/2002 Hamada et al.
D467,292 S 12/2002 Saraie et al.
D473,605 S 4/2003 Petersen et al.
6,547,675 B2 4/2003 Sherwood
6,592,468 B2 * 7/2003 Vincent ..... A63B 53/047 473/345
6,592,469 B2 7/2003 Gilbert
6,616,546 B2 9/2003 Cho
6,616,547 B2 9/2003 Vincent et al.
6,638,183 B2 10/2003 Takeda
6,688,989 B2 2/2004 Best
6,733,400 B2 5/2004 Sherwood
D492,376 S 6/2004 Nicolette et al.
6,743,114 B2 6/2004 Best
6,746,344 B1 6/2004 Long
6,811,496 B2 11/2004 Wahl et al.
D500,825 S 1/2005 Madore
D501,035 S 1/2005 Wahl et al.
D501,234 S 1/2005 Cheng
6,849,005 B2 2/2005 Rife
6,855,066 B2 2/2005 Best
6,855,069 B2 2/2005 Nagai et al.
D503,204 S 3/2005 Nicolette et al.
6,863,621 B2 3/2005 Sherwood
D505,466 S 5/2005 Lang et al.
6,921,343 B2 * 7/2005 Solheim ..... A63B 60/00 473/340
D508,722 S 8/2005 Iwata et al.
D510,115 S 9/2005 Lang et al.
6,942,580 B2 9/2005 Hou et al.
D511,553 S 11/2005 Madore
D512,757 S 12/2005 Cleveland et al.
6,979,270 B1 12/2005 Allen
6,984,180 B2 1/2006 Hasebe
D517,146 S 3/2006 Nishitani
7,018,305 B2 3/2006 Sugimoto
D518,539 S 4/2006 Cleveland et al.
D523,501 S 6/2006 Nicolette et al.
7,070,513 B2 7/2006 Takeda et al.
D526,036 S 8/2006 Nishitani
7,083,530 B2 8/2006 Wahl et al.
7,086,961 B2 8/2006 Wright et al.
D529,114 S 9/2006 Madore
D529,970 S 10/2006 Madore
7,115,048 B2 10/2006 Kusumoto et al.
D532,850 S 11/2006 Oldknow
7,134,971 B2 * 11/2006 Franklin ..... A63B 53/06 473/340
D537,138 S 2/2007 Clausen et al.
D537,494 S 2/2007 Jertson et al.
7,186,187 B2 3/2007 Gilbert et al.
7,186,188 B2 3/2007 Gilbert et al.
7,192,361 B2 3/2007 Gilbert et al.
7,192,362 B2 3/2007 Gilbert et al.
D539,864 S 4/2007 Nicolette et al.
D540,898 S 4/2007 Solheim et al.
D544,056 S 6/2007 Nicolette et al.
7,232,377 B2 6/2007 Gilbert et al.
D549,797 S 8/2007 Oldknow
D550,317 S 9/2007 Oldknow
D554,215 S 10/2007 Ruggiero et al.
D554,217 S 10/2007 Ruggiero et al.
D554,218 S 10/2007 Ruggiero et al.
D560,263 S 1/2008 Rubino
D565,685 S 4/2008 Homma
D571,887 S 6/2008 Stites et al.
D573,677 S 7/2008 Kadoya
D573,680 S 7/2008 Stites et al.
7,393,287 B2 7/2008 Huang
7,396,290 B2 7/2008 Gilbert et al.
D577,087 S 9/2008 Roach et al.
D577,088 S 9/2008 Clausen et al.
D581,000 S 11/2008 Nicolette et al.
D584,371 S 1/2009 Chick et al.
D585,951 S 2/2009 Kohno
D588,667 S 3/2009 Oldknow
D588,685 S 3/2009 Chong
D589,105 S 3/2009 Oldknow
D589,108 S 3/2009 Oldknow
D589,109 S 3/2009 Oldknow
D592,715 S 5/2009 Takei
D595,797 S 7/2009 Oldknow
D596,256 S 7/2009 Schweigert et al.
D596,257 S 7/2009 Jertson et al.
D596,258 S 7/2009 Jertson et al.
D596,684 S 7/2009 Sutovsky et al.
D596,688 S 7/2009 Schweigert et al.
D597,157 S 7/2009 Wallin et al.
7,559,850 B2 7/2009 Gilbert et al.
D597,616 S 8/2009 Ines et al.
D597,617 S 8/2009 Ines et al.
D597,618 S 8/2009 Ines et al.
D598,060 S 8/2009 Barez et al.
D599,423 S 9/2009 Serrano et al.
7,582,024 B2 9/2009 Shear
D601,651 S 10/2009 Jorgensen et al.
D602,103 S 10/2009 Jorgensen et al.
D604,783 S 11/2009 Nicolette et al.
D607,073 S 12/2009 Jertson et al.
7,686,704 B2 3/2010 Gilbert et al.
7,744,486 B2 6/2010 Hou et al.
D619,183 S 7/2010 Llewellyn et al.
7,749,102 B2 7/2010 Nakamura
D621,893 S 8/2010 Nicolette et al.
D621,894 S 8/2010 Schweigert
7,857,711 B2 12/2010 Shear
7,867,105 B2 * 1/2011 Moon ..... A63B 60/02 473/345
D633,159 S 2/2011 Holt et al.
D635,627 S 4/2011 Nicolette
7,976,403 B2 7/2011 Gilbert et al.
D643,491 S 8/2011 Stokke et al.
D647,582 S 10/2011 Nicolette et al.
8,033,927 B2 10/2011 Gilbert et al.
8,033,931 B2 10/2011 Wahl et al.
8,088,023 B2 * 1/2012 Kubota ..... A63B 53/047 473/335
D654,547 S 2/2012 Jertson et al.
8,157,668 B2 4/2012 Wahl et al.
D658,733 S 5/2012 Oldknow et al.
D659,214 S 5/2012 Oldknow et al.
D661,755 S 6/2012 Oldknow et al.
8,197,354 B2 6/2012 Gilbert et al.
8,246,487 B1 * 8/2012 Cackett ..... A63B 53/047 473/335
8,277,337 B2 * 10/2012 Shimazaki ..... A63B 60/02 473/332
8,298,095 B2 10/2012 Gilbert et al.
8,302,658 B2 11/2012 Gilbert et al.
8,403,771 B1 * 3/2013 Rice ..... A63B 53/0466 473/328
8,911,301 B1 12/2014 Allen
8,911,302 B1 * 12/2014 Ivanova ..... A63B 53/06 473/332
8,915,797 B1 * 12/2014 Kuhar ..... A63B 53/0475 473/335
8,956,242 B2 * 2/2015 Rice ..... A63B 60/54 473/332
9,044,653 B2 6/2015 Wahl et al.
9,623,298 B2 * 4/2017 Ban ..... A63B 60/52
9,802,089 B2 * 10/2017 Honea ..... A63B 60/02
10,398,950 B2 * 9/2019 Honea ..... A63B 60/02
10,888,749 B2 * 1/2021 Honea ..... A63B 60/02
2001/0055996 A1 12/2001 Iwata et al.

(56) References Cited

U.S. PATENT DOCUMENTS

2002/0068645 A1* 6/2002 Vincent ..... A63B 60/02 473/338
2002/0082119 A1 6/2002 Hamada et al.
2002/0094883 A1 7/2002 Chuang
2002/0098910 A1* 7/2002 Gilbert ..... A63B 60/02 473/332
2004/0023729 A1 2/2004 Nagai et al.
2004/0058745 A1* 3/2004 Clausen ..... A63B 53/047 473/349
2004/0058747 A1* 3/2004 Clausen ..... A63B 53/047 473/349
2004/0171434 A1 9/2004 Radcliffe et al.
2004/0180730 A1 9/2004 Franklin et al.
2004/0214657 A1* 10/2004 Hou ..... A63B 60/02 473/335
2005/0009626 A1* 1/2005 Imamoto ..... A63B 53/047 473/345
2005/0037860 A1* 2/2005 Gilbert ..... A63B 53/04 473/349
2005/0037863 A1* 2/2005 Gilbert ..... A63B 53/047 473/349
2005/0043117 A1* 2/2005 Gilbert ..... A63B 53/0466 473/345
2005/0090329 A1* 4/2005 Gilbert ..... A63B 60/54 473/349
2005/0096151 A1* 5/2005 Hou ..... A63B 53/04 473/335
2005/0143188 A1* 6/2005 Tseng ..... A63B 60/00 473/332
2005/0143190 A1 6/2005 Takeda
2005/0197208 A1* 9/2005 Imamoto ..... A63B 53/047 473/349
2005/0227781 A1 10/2005 Huang et al.
2005/0239569 A1* 10/2005 Best ..... A63B 53/0475 473/290
2005/0277484 A1* 12/2005 Reed ..... A63B 53/047 473/332
2006/0025237 A1* 2/2006 Aguinaldo ..... A63B 53/047 473/350
2007/0026961 A1 2/2007 Hou
2007/0042836 A1* 2/2007 Best ..... A63B 53/047 473/291
2007/0099721 A1* 5/2007 Chen ..... A63B 53/0466 473/332
2007/0281796 A1* 12/2007 Gilbert ..... A63B 53/04 473/332
2008/0085781 A1* 4/2008 Iwahori ..... A63B 53/047 473/332
2009/0023513 A1* 1/2009 Shibata ..... A63B 53/0475 473/305
2009/0191979 A1 7/2009 Hou et al.
2009/0221382 A1* 9/2009 Soracco ..... A63B 60/54 473/291
2009/0298615 A1* 12/2009 Moon ..... A63B 53/047 473/282
2011/0021285 A1* 1/2011 Shimazaki ..... A63B 60/54 473/332
2011/0028240 A1* 2/2011 Wahl ..... A63B 53/047 473/346
2011/0070970 A1 3/2011 Wan
2012/0034997 A1 2/2012 Swartz
2012/0196703 A1* 8/2012 Sander ..... A63B 60/52 473/349
2012/0244960 A1 9/2012 Tang et al.
2013/0331201 A1* 12/2013 Wahl ..... A63B 60/00 473/329
2014/0274442 A1* 9/2014 Honea ..... A63B 53/047 473/291
2014/0335973 A1* 11/2014 Takechi ..... A63B 53/047 473/349
2015/0133232 A1* 5/2015 Taylor ..... A63B 60/00 473/329
2015/0343281 A1* 12/2015 Ban ..... A63B 53/047 473/332
2016/0038796 A1* 2/2016 Taylor ..... A63B 53/047 473/349
2017/0326416 A1* 11/2017 Pergande ..... A63B 53/06

FOREIGN PATENT DOCUMENTS

GB 2126486 A 3/1984
GB 2381468 A 5/2003
GB 2381468 B 7/2004
JP 3035480 U 3/1997
JP 11104283 4/1999
JP 11178961 A 7/1999
JP 2001-204863 7/2001
JP 2002248183 9/2002
JP 3392022 B2 3/2003
JP 2004275700 A 10/2004
JP 2005118526 A 5/2005
TW 512741 U 12/2002
WO 2002043819 A2 6/2002
WO 2002043819 A3 6/2002

* cited by examiner

IRON TYPE GOLF CLUB HEAD AND SET

CROSS-REFERENCE TO RELATED APPLICATIONS

This application is a continuation of U.S. nonprovisional application Ser. No. 16,524,240, filed on Jul. 29, 2019, which is a continuation of U.S. nonprovisional application Ser. No. 15/794,473, filed on Oct. 26, 2017, now U.S. Pat. No. 10,398,950, which is a divisional application of U.S. nonprovisional application Ser. No. 13/842,545, now U.S. Pat. No. 9,802,089, filed on Mar. 15, 2013, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of golf clubs, namely iron-type golf club heads, clubs, and an associated set.

BACKGROUND OF THE INVENTION

A golf set includes various types of clubs for use in different conditions or circumstances in which a ball is hit during a golf game. A set of clubs typically includes a "driver" for hitting the ball the longest distance on a course. A fairway "wood" can be used for hitting the ball shorter distances than the driver. A set of irons are used for hitting the ball within a range of distances typically shorter than the driver or woods. Every club has an ideal striking location or "sweet spot" that represents the best hitting zone on the face for maximizing the probability of the golfer achieving the best and most predictable shot using the particular club.

An iron has a flat face that normally contacts the ball whenever the ball is being hit with the iron. Irons have angled faces for achieving lofts ranging from about 18 degrees to about 64 degrees. The size of an iron's sweet spot is generally related to the size (i.e., surface area) of the iron's striking face, and iron sets are available with oversize club heads to provide a large sweet spot that is desirable to many golfers. Most golfers strive to make contact with the ball inside the sweet spot to achieve a desired ball speed, distance, and trajectory.

Conventional "blade" type irons have been largely displaced (especially for novice golfers) by so-called "perimeter weighted" irons, which include "cavity-back" and "hollow" iron designs. Cavity-back irons have a cavity directly behind the striking plate, which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of mass or a moment of inertia. These designs also permit club designers to provide striking plates that have relatively large face areas that are unsupported by the main body of the golf club head.

SUMMARY OF INVENTION

In its most general configuration, the present invention advances the state of the art with a variety of new capabilities and overcomes many of the shortcomings of prior methods in new and novel ways. In its most general sense, the present invention overcomes the shortcomings and limitations of the prior art in any of a number of generally effective configurations. This disclosure includes an iron-type golf club head having a sole channel extending from an exterior of a sole portion toward a face. The sole channel has an axis that intersects the face at an axis-to-face intersection point for at least one position along a channel length, and preferably at least 25% of the channel length. The elevation of the intersection point may below the Ycg distance and the axis defines an angle from the vertical that may be related to the loft. Further, the iron-type golf club head may be incorporated in a set containing club heads with varying degrees of unsupported face area.

BRIEF DESCRIPTION OF THE DRAWINGS

Without limiting the scope of the present invention as claimed below and referring now to the drawings and figures:

FIG. 8(*b*) shows a front elevation view of an iron-type golf club head of an embodiment of the present invention with the face removed, not to scale;

FIG. 8(*c*) shows a bottom plan view of an iron-type golf club head of an embodiment of the present invention with the face removed, not to scale;

FIG. 8(*d*) shows an enlarged cross-sectional view taken along section line 8(*d*)-8(*d*) of FIG. 8(*a*) of an iron-type golf club head of an embodiment of the present invention, not to scale;

FIG. 9(*b*) shows a front elevation view of an iron-type golf club head of an embodiment of the present invention with the face removed, not to scale;

FIG. 9(*c*) shows a bottom plan view of an iron-type golf club head of an embodiment of the present invention with the face removed, not to scale;

FIG. 9(*d*) shows an enlarged cross-sectional view taken along section line 9(*d*)-9(*d*) of FIG. 9(*a*) of an iron-type golf club head of an embodiment of the present invention, not to scale;

Figure 1:
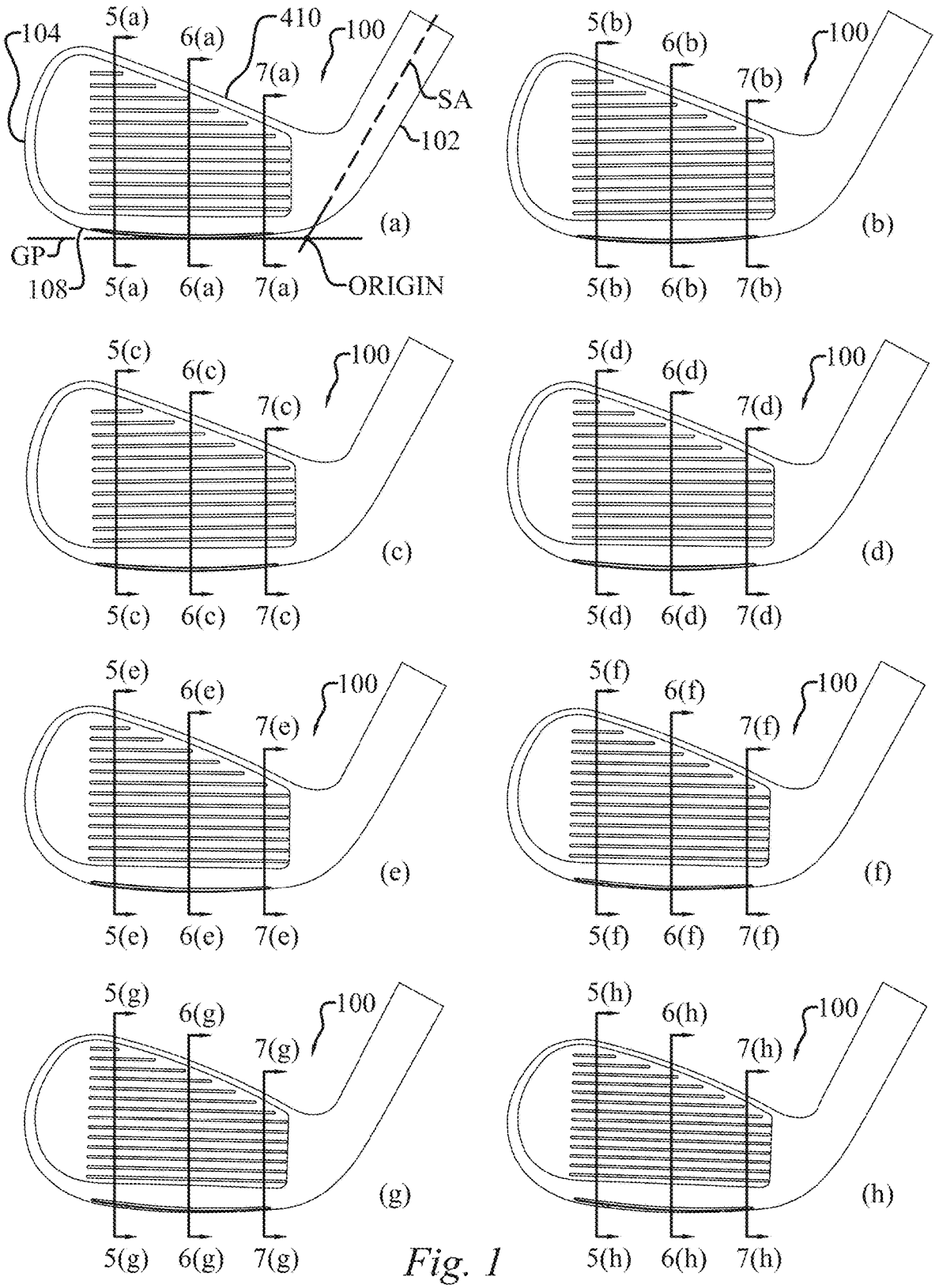
FIG. 1 shows a front elevation view of eight iron-type golf club heads of the present invention, not to scale.
Figure 2:
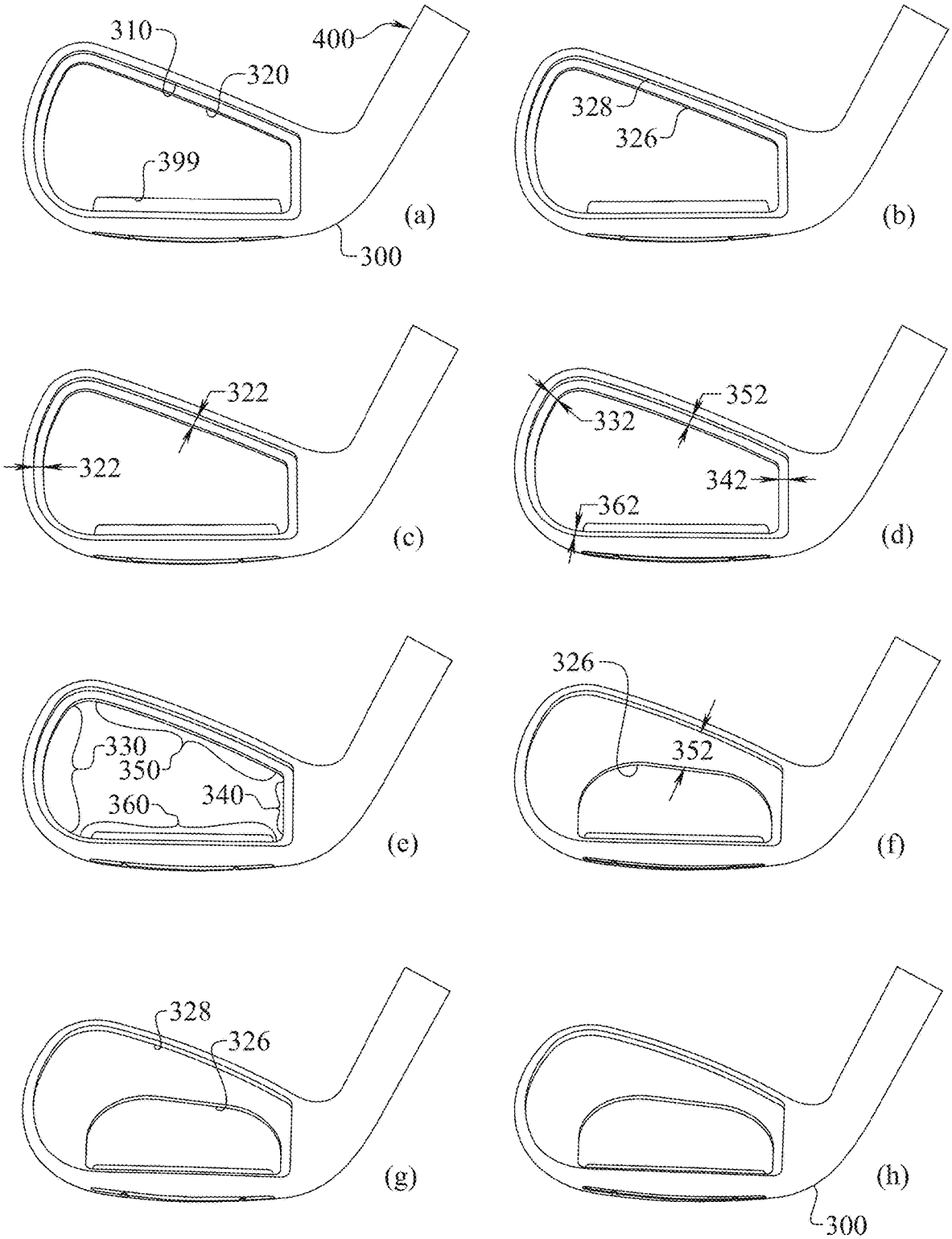
FIG. 2 shows a front elevation view of eight iron-type golf club heads of an embodiment of the present invention with the face removed, not to scale.

These drawings are provided to assist in the understanding of the exemplary embodiments of the present golf club as described in more detail below and should not be construed as unduly limiting the golf club. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The iron-type golf club head (100) and set of golf club heads of the present invention enables a significant advance in the state of the art. The preferred embodiments of the golf club head(s) accomplish this by new and novel methods that are configured in unique and novel ways and which demonstrate previously unavailable, but preferred and desirable capabilities. The description set forth below in connection with the drawings is intended merely as a description of the presently preferred embodiments of the golf club head(s), and is not intended to represent the only form in which the present golf club head(s) may be constructed or utilized. The description sets forth the designs, functions, means, and methods of implementing the golf club head(s) in connection with the illustrated embodiments. It is to be understood, however, that the same or equivalent functions and features may be accomplished by different embodiments that are also intended to be encompassed within the spirit and scope of the claimed golf club head(s) and associated set.

In order to fully appreciate the present disclosed golf club head some common terms must be defined for use herein. First, one of skill in the art will know the meaning of "center of gravity," referred to herein as CG, from an entry level course on the mechanics of solids. The CG is often thought of as the intersection of all the balance points of the golf club head. In other words, if you balance the head on the face and then on the sole, the intersection of the two imaginary lines passing straight through the balance points would define the point referred to as the CG.

It is helpful to establish a coordinate system to identify and discuss the location of the CG. In order to establish this coordinate system one must first identify a ground plane (GP) and a shaft axis (SA), as seen in FIG. 1. The ground plane (GP) is the horizontal plane upon which a golf club head rests, as seen best in a front elevation view of a golf club head looking at the face of the golf club head, as seen in FIG. 1. The shaft axis (SA) is the axis of a bore in the golf club head that is designed to receive a shaft. The shaft axis (SA) is fixed by the design of the golf club head.

Now, the intersection of the shaft axis (SA) with the ground plane (GP) fixes an origin point, labeled "origin" in FIG. 1, for the coordinate system. While it is common knowledge in the industry, it is worth noting that the right side of the club head seen in FIG. 1, the side nearest the bore in which the shaft attaches, is the "heel" side of the golf club head; and the opposite side, the left side in FIG. 1, is referred to as the "toe" side of the golf club head. Additionally, the portion of the golf club head that actually strikes a golf ball is referred to as the face of the golf club head and is commonly referred to as the front of the golf club head; whereas the opposite end of the golf club head is referred to as the rear of the golf club head and/or the trailing edge.

A three dimensional coordinate system may now be established from the origin with the Y-direction being the vertical direction from the origin; the X-direction being the horizontal direction perpendicular to the Y-direction and wherein the X-direction is parallel to the face of the golf club head in the natural resting position, also known as the design position; and the Z-direction is perpendicular to the X-direction wherein the Z-direction is the direction toward the rear of the golf club head. The X, Y, and Z directions are noted on a coordinate system symbol in FIGS. 8(*a*) and 8(*d*). It should be noted that this coordinate system is contrary to the traditional right-hand rule coordinate system; however it is preferred so that the center of gravity may be referred to as having all positive coordinates.

Now, with the origin and coordinate system defined, the terms that define the location of the CG may be explained. The distance behind the origin that the CG is located is referred to as Zcg, as seen in FIG. 8(*d*). Similarly, the distance above the origin that the CG is located is referred to as Ycg, as seen in FIG. 8(*a*). Lastly, the horizontal distance from the origin that the CG is located is referred to as Xcg, also seen in FIG. 8(*a*). Therefore, the location of the CG may be easily identified by reference to Xcg, Ycg, and Zcg distances.

The moment of inertia of the golf club head is a key ingredient in the playability of the club. Again, one skilled in the art will understand what is meant by moment of inertia with respect to golf club heads; however it is helpful to define two moment of inertia components that will be commonly referred to herein. First, MOIx, often referred to as the lofting/delofting moment of inertia, is the moment of inertia of the golf club head around an axis through the CG, parallel to the X-axis. MOIx is the moment of inertia of the golf club head that resists lofting and delofting moments induced by ball strikes high or low on the face. Secondly, MOIy, often referred to as the opening/closing moment of inertial, is the moment of the inertia of the golf club head around an axis through the CG, parallel to the Y-axis. MOIy is the moment of inertia of the golf club head that resists opening and closing moments induced by ball strikes towards the toe side or heel side of the face. The "front-to-back" dimension, referred to as the FB dimension, is the distance from the furthest forward point at the leading edge of the golf club head to the furthest rearward point at the rear of the golf club head along the sole portion, i.e. the trailing edge.

The iron-type golf club head (100) includes a heel portion (102), a toe portion (104), a top line portion (106), a sole portion (108), a leading edge (110), a trailing edge (112), a face (200) oriented at a loft, labeled in FIG. 8(*d*), and a hosel (400) having a bore (410) that defines a shaft axis (SA) intersecting a horizontal ground plane (GP) to define an origin point. The iron-type golf club head (100) includes a sole channel (380), best seen in FIGS. 8(*d*) and 9(*d*), extending from the exterior of the sole portion (108) toward the face (200), wherein the sole channel (380) has a channel leading edge (382), a channel trailing edge (384), a channel width (386), a channel length (388), a channel depth (390), a channel leading edge setback (392), and a channel axis (394) establishing a channel angle (396) from the vertical.

The channel axis (394) intersects the face (200) at an axis-to-face intersection point (395) for at least one position along the channel length (388), illustrated best in FIGS. 8(*d*) and 9(*d*). In one particular embodiment at least one position along the channel length (388) has the axis-to-face intersection point (395) at an elevation above the horizontal ground plane (GP) that is less than the distance Ycg. An even further embodiment has at least one position along the channel length (388) having the axis-to-face intersection point at an elevation above the horizontal ground plane that is less than 60% of the distance Ycg. Having a channel axis (394) that intersects the face (200) in at least one position along the channel length (388) means that the channel axis (394) at this position is not parallel, nor nearly parallel, to the face (200), unlike much prior art.

In fact in some embodiments at least a portion of the channel length (388) has a sole channel (380) characterized by a channel axis (394) that is angled toward the face (200). For example, in one embodiment a portion of the sole channel (380) has a channel angle (396) that is at least 20% of the loft. An even further embodiment has a channel length (388) that is greater than the Xcg distance, and a channel angle (396) that is at least 20% of the loft throughout at least 25% of the channel length (388). In other words, a significant portion of the sole channel (380) is angled toward the face (200).

Another embodiment has a portion of the sole channel (380) with a channel angle (396) that is at least 50% of the loft. A further embodiment takes this a step further and also has a channel length (388) that is greater than the Xcg distance, and a channel angle (396) that is at least 50% of the loft throughout at least 50% of the channel length (388).

Even further embodiments obtain desired performance when the channel length (388) is greater than the Xcg distance, and the channel angle (396) is at least 50% of the loft, and less than 150% of the loft, throughout at least 25% of the channel length (388). Another embodiment incorporates a narrower operating window in which the channel length (388) is greater than the Xcg distance, and the channel angle (396) is at least 75% of the loft, and less than 125% of the loft, throughout at least 25% of the channel length (388).

Even further embodiments incorporates a sole channel (380) that extends through the body sole portion (108) and creates a passageway (398) from the exterior of the body sole portion (108) to a termination opening (399) that is open to a void behind the face (200), seen best in FIGS. 8(*d*) and 9(*d*). In one particular embodiment of this variation the sole channel (380) extends through the sole portion (108) creating the passageway (398) throughout at least 50% of the channel length (388).

The aforementioned relationships resulting in a particular axis-to-face intersection point (395), elevation of the axis-to-face intersection point (395), channel angle (396), channel length (388), and/or formation of a through passageway (398) in communication with a void behind the face, thereby achieve improved performance of the iron-type golf club head (100), which generally means a higher Characteristic Time (CT), and improved durability. While the disclosure above covers cast club heads, forged club heads, and variations of multi-material and multi-component cast and forged club heads, the design is particularly beneficial in constructing an iron-type golf club head (100) having a forged body (300) of a relatively soft material such as AISI 1025 carbon steel where testing has shown the channel angle (396) and channel setback (392) significantly influence the durability. This is particularly true when the face (200) is a separate piece of high strength alloy material that is different from the forged body (300). Thus, in one particular embodiment the body (300) is forged from a carbon steel alloy, and the face (200) is forged of a high strength alloy having a yield strength of at least 1400 MPa. The combination of a soft forged body (300) with a hard high strength (200) face provides the feel that a better player enjoys in light of the sole channel (380) and its position and orientation. In a further embodiment the face (200) has a thickness that is 2 mm or less and the channel width (386) is greater than the face thickness.

The iron-type golf club head (100) may also be incorporated into a set of iron-type golf club heads, as illustrated generally as a 3-iron through a pitching wedge as drawings (a) through (h) in FIGS. 1-7. For convenience the following disclosure will refer to a first iron-type golf club head, a second iron-type golf club head, and a third iron-type golf club head, which will be distinguished from one another by loft. Specific element numbers will only be used below with reference to the first iron-type golf club head unless specifically needed to explain a point, however one with skill in the art will recognize their associated application to the second iron-type golf club head and the third iron-type golf club head.

The set includes at least a first iron-type golf club head having a first loft of 30 degrees or less, and a second iron-type golf club head having a second loft of at least 31 degrees. The first iron-type golf club head (100) has a first heel portion (102), a first toe portion (104), a first top line portion (106), a first sole portion (108), a first leading edge (110), and a first trailing edge (112). Additionally, in this embodiment the first iron-type golf club head (100) includes a first body (300) and a first face (200). The first body (300) is formed of a first body material and having a first hosel (400), a first face opening (310), and a first face support ledge (320), seen in FIG. 2(*a*). The first face support ledge (320) has a first support ledge width (322) separating a first support ledge inner perimeter (326) from a first support ledge outer perimeter (328), and may have a first support ledge setback (324), although the ledge is not necessarily recessed within the body. The first hosel (400) has a first bore (410) and a first bore center that defines a first shaft axis (SA) which intersects with a horizontal ground plane (GP) to define a first origin point. The first face (200) is formed of a first face material that is different from the first body (300) material and configured to be rigidly supported by the first body face opening (310). The face (200) has a first face perimeter (210), a first face thickness (220), a first face striking surface (250), and a first face rear surface (260).

Figure 11:
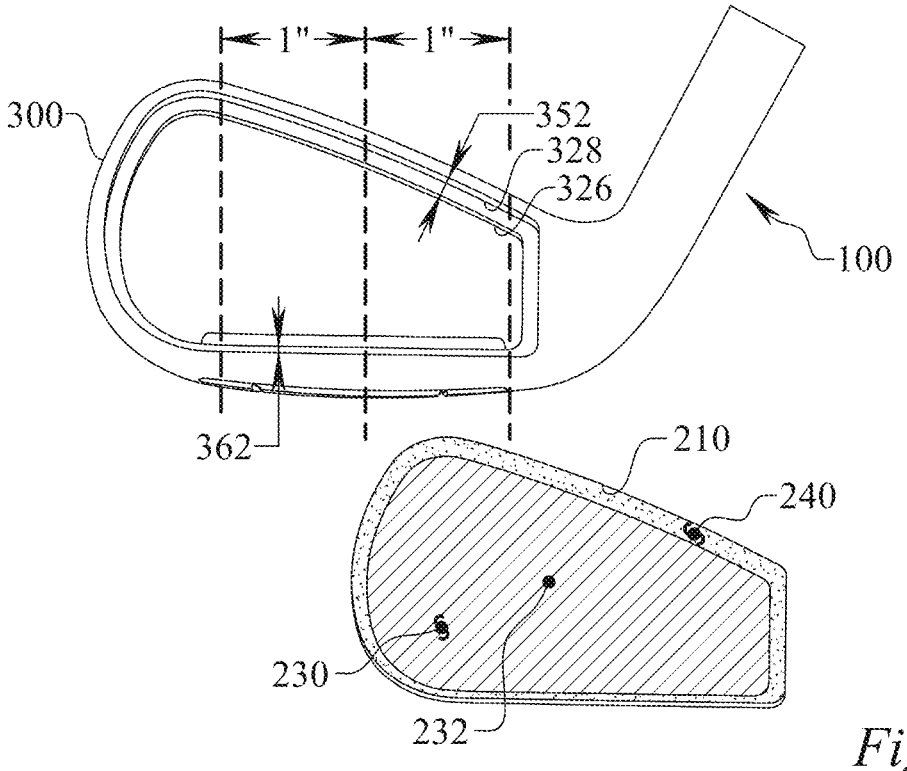
FIG. 11 shows an assembly view of an embodiment of an iron-type golf club head of the present invention with the face removed, not to scale.
Figure 12:
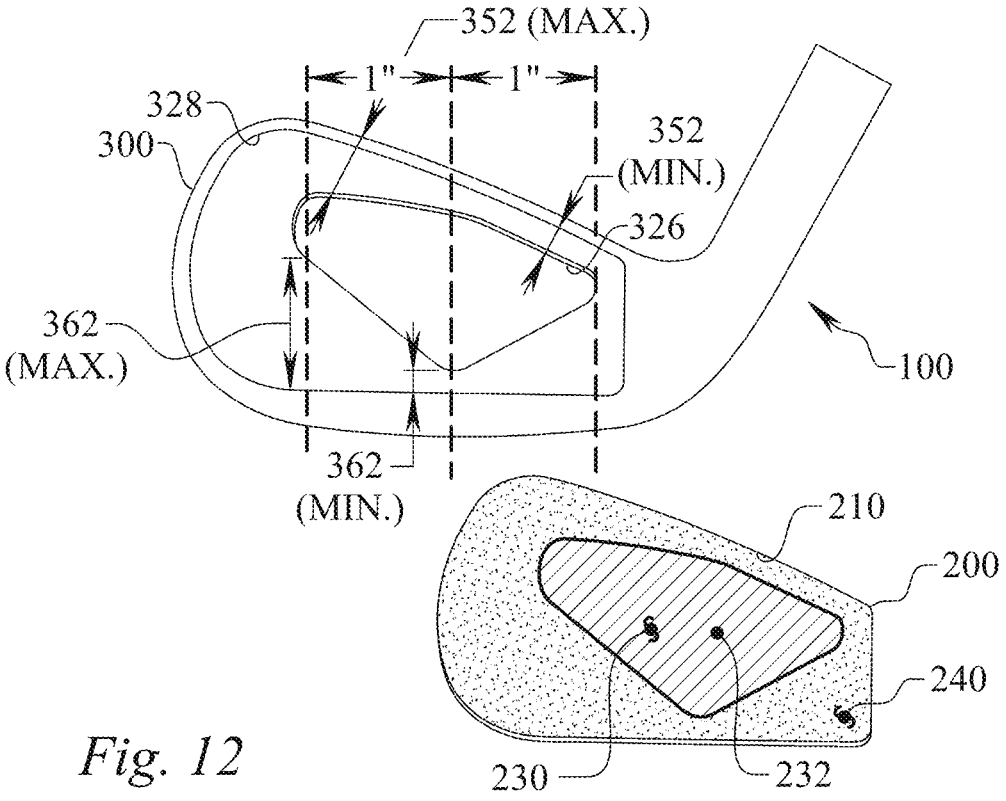
FIG. 12 shows an assembly view of an embodiment of an iron-type golf club head of the present invention with the face removed, not to scale.

A portion of the first face rear surface (260) contacts the first face support ledge (320) thereby defining a first supported face portion (240), illustrated best in FIGS. 11-12, having a first supported face area. Additionally, a portion of the first face rear surface (260) does not contact the first face support ledge (320) thereby defining a first unsupported face portion (230) having a first unsupported face area, wherein the sum of the first supported face area and the first unsupported face area is a first total face area.

The first iron-type golf club head (100) has a first center of gravity (CG) located (a) vertically toward the first top line portion (106) of the first iron-type golf club head (100) from the first origin point a first distance Ycg; (b) horizontally from the first origin point toward the first toe portion (104) of the first iron-type golf club head (100) a first distance Xcg; and (c) a first distance Zcg from the first origin toward the first trailing edge (112) in a direction generally orthogonal to the vertical direction used to measure the first Ycg distance and generally orthogonal to the horizontal direction used to measure the first Xcg distance, as illustrated in FIGS. 8(*a*) and 8(*d*). The first iron-type golf club head (100) has a first opening/closing moment of inertia about a first vertical axis through the first center of gravity (CG).

As previously mentioned, the second iron-type golf club head has a second loft of at least 31 degrees. The second iron-type golf club head has a second heel portion, a second toe portion, a second top line portion, a second sole portion, a second leading edge, and a second trailing edge. Additionally, in this embodiment the second iron-type golf club head includes a second body and a second face. The second body is formed of a second body material and has a second hosel, a second face opening, and a second face support ledge. The second face support ledge has a second support ledge width separating a second support ledge inner perimeter from a second support ledge outer perimeter, and may have a second support ledge setback. The second hosel has a second bore and a second bore center that defines a second shaft axis which intersects with a horizontal ground plane to define a second origin point. The second face is formed of a second face material that is different from the second body material and configured to be rigidly supported by the second body face opening. The face has a second face perimeter, a second face thickness, a second face striking surface, and a second face rear surface.

A portion of the second face rear surface contacts the second face support ledge thereby defining a second supported face portion, having a second supported face area. Additionally, a portion of the second face rear surface does not contact the second face support ledge thereby defining a second unsupported face portion having a second unsupported face area, wherein the sum of the second supported face area and the second unsupported face area is a second total face area.

The second iron-type golf club head has a second center of gravity located (a) vertically toward the second top line portion of the second iron-type golf club head from the second origin point a second distance Ycg; (b) horizontally from the second origin point toward the second toe portion of the second iron-type golf club head a second distance Xcg; and (c) a second distance Zcg from the second origin toward the second trailing edge in a direction generally orthogonal to the vertical direction used to measure the second Ycg distance and generally orthogonal to the horizontal direction used to measure the second Xcg distance. The second iron-type golf club head has a second opening/closing moment of inertia about a second vertical axis through the second center of gravity.

Figure 3:
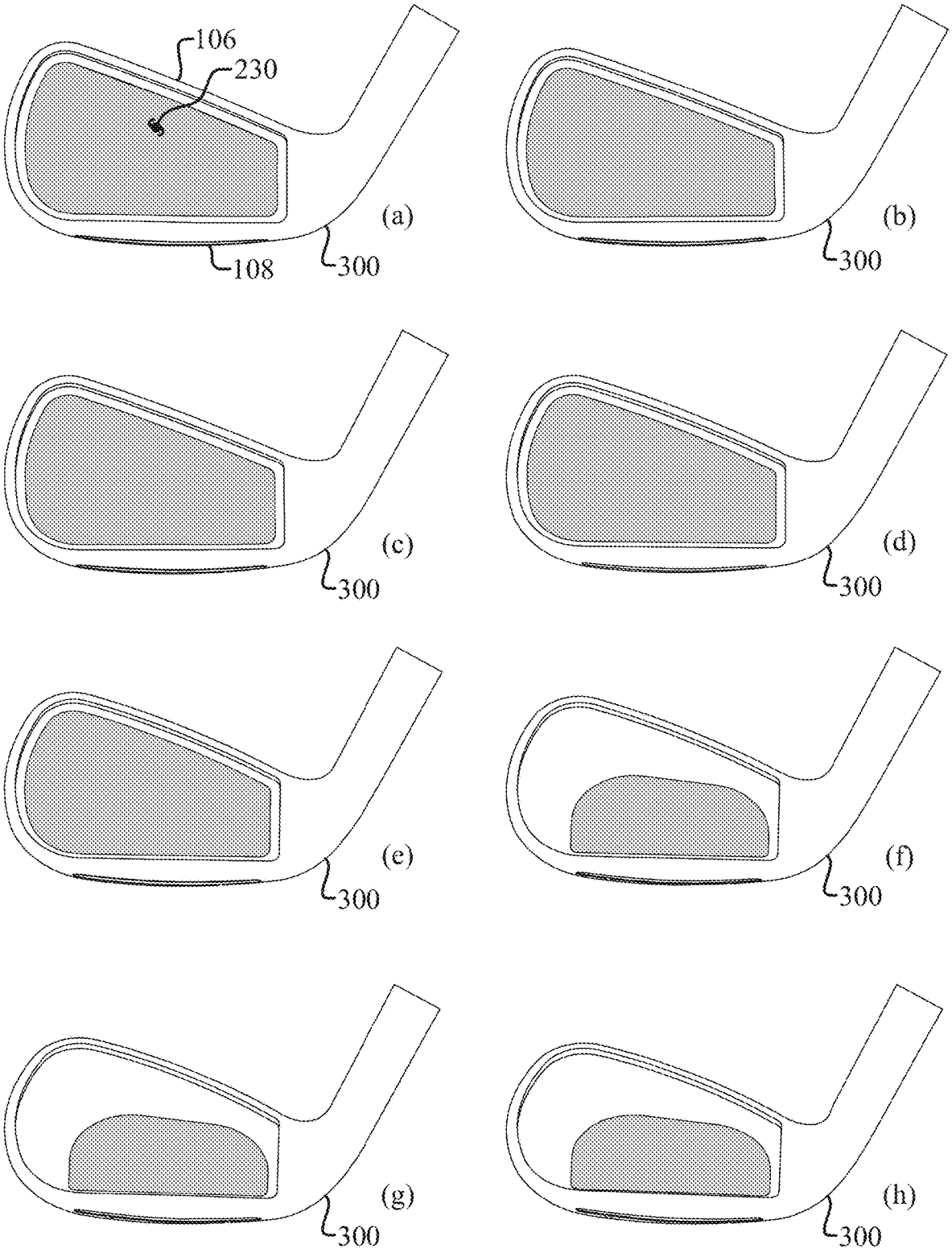
FIG. 3 shows a front elevation view of eight iron-type golf club heads of an embodiment of the present invention with the face removed and the unsupported portion of the face shaded, not to scale.
Figure 4:
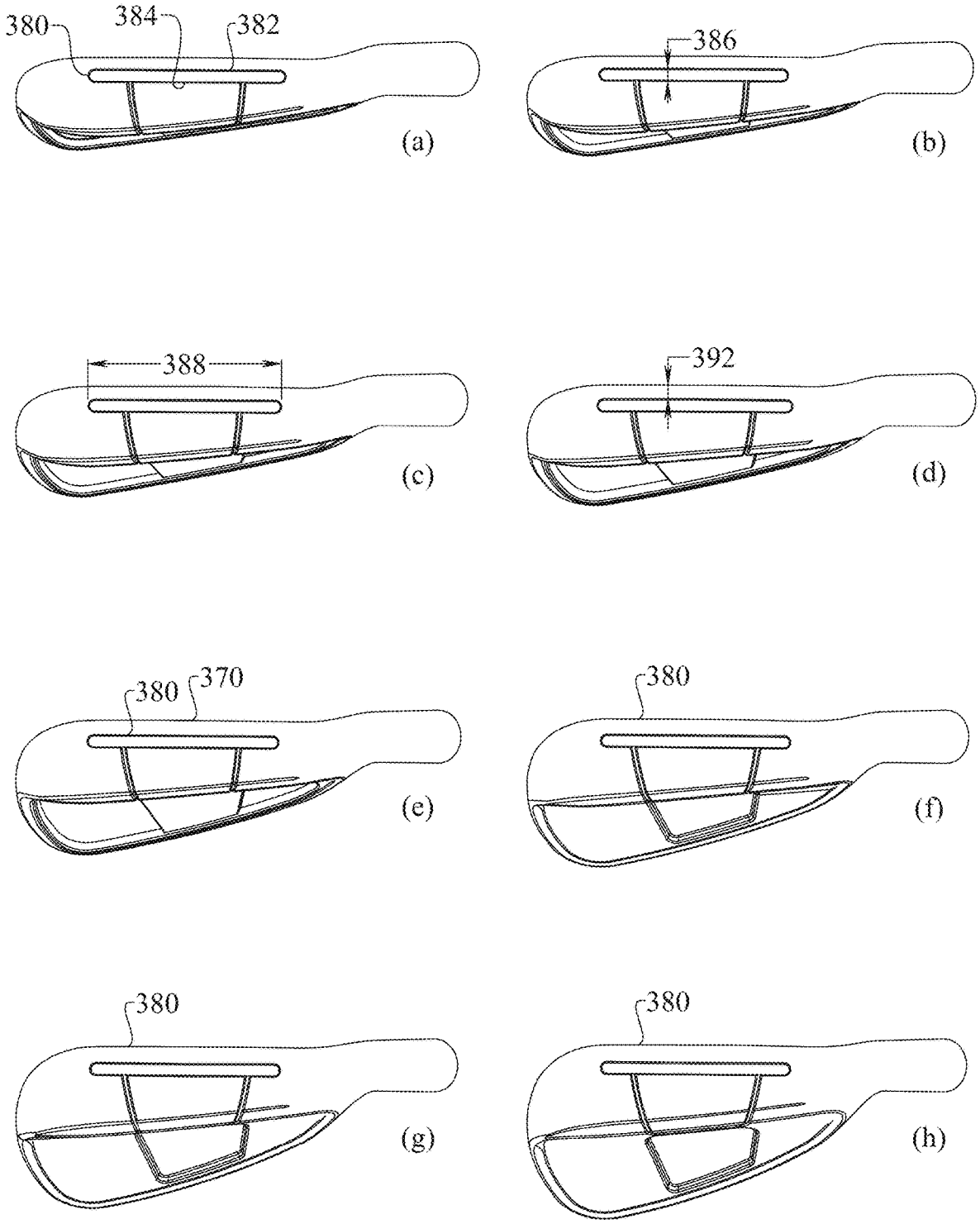
FIG. 4 shows a bottom plan view of eight iron-type golf club heads of the present invention, not to scale.
Figure 5:
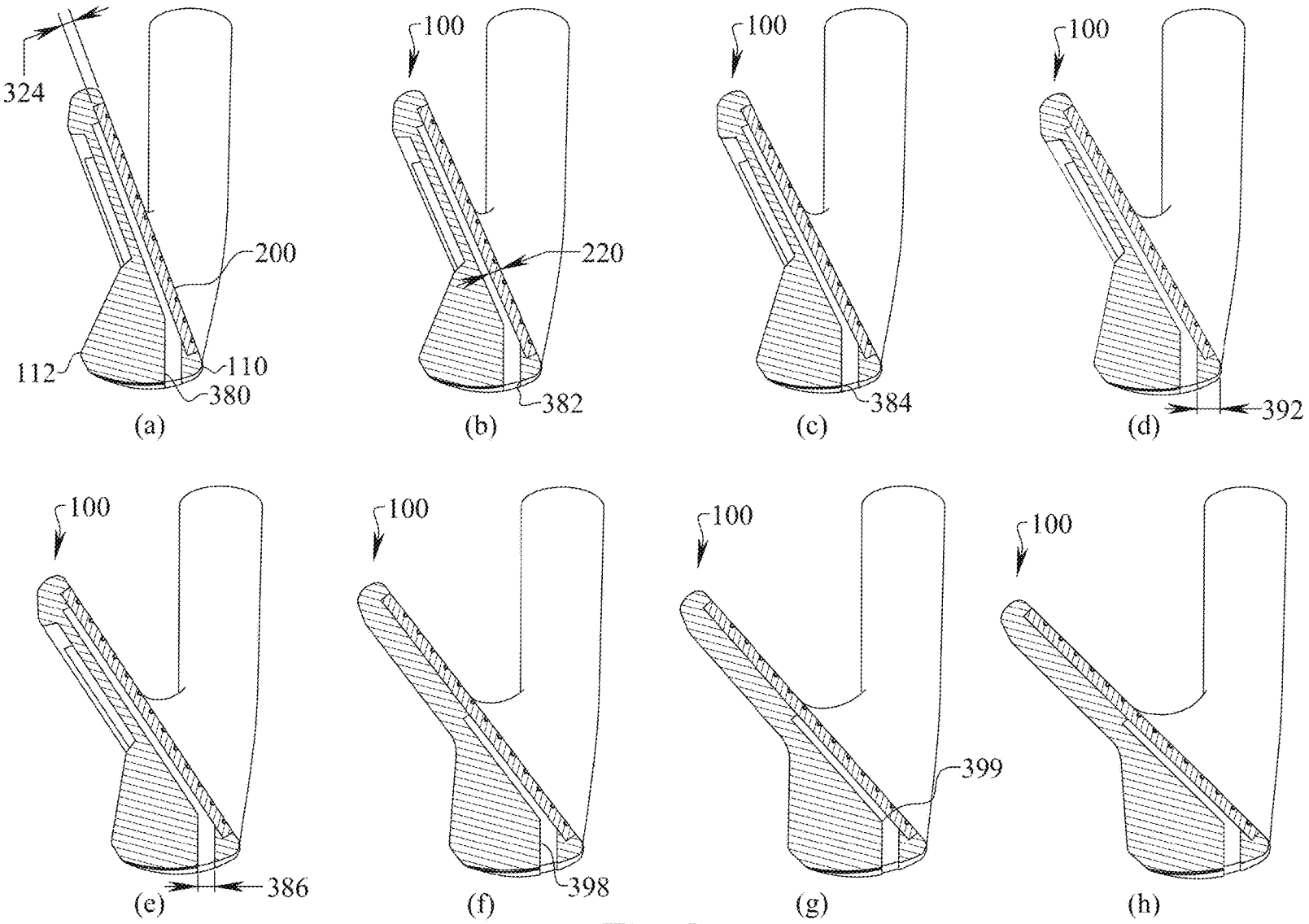
FIG. 5 shows a cross-sectional view taken along section lines (5)-(5) in FIG. 1 of eight iron-type golf club heads of the present invention, not to scale.
Figure 6:
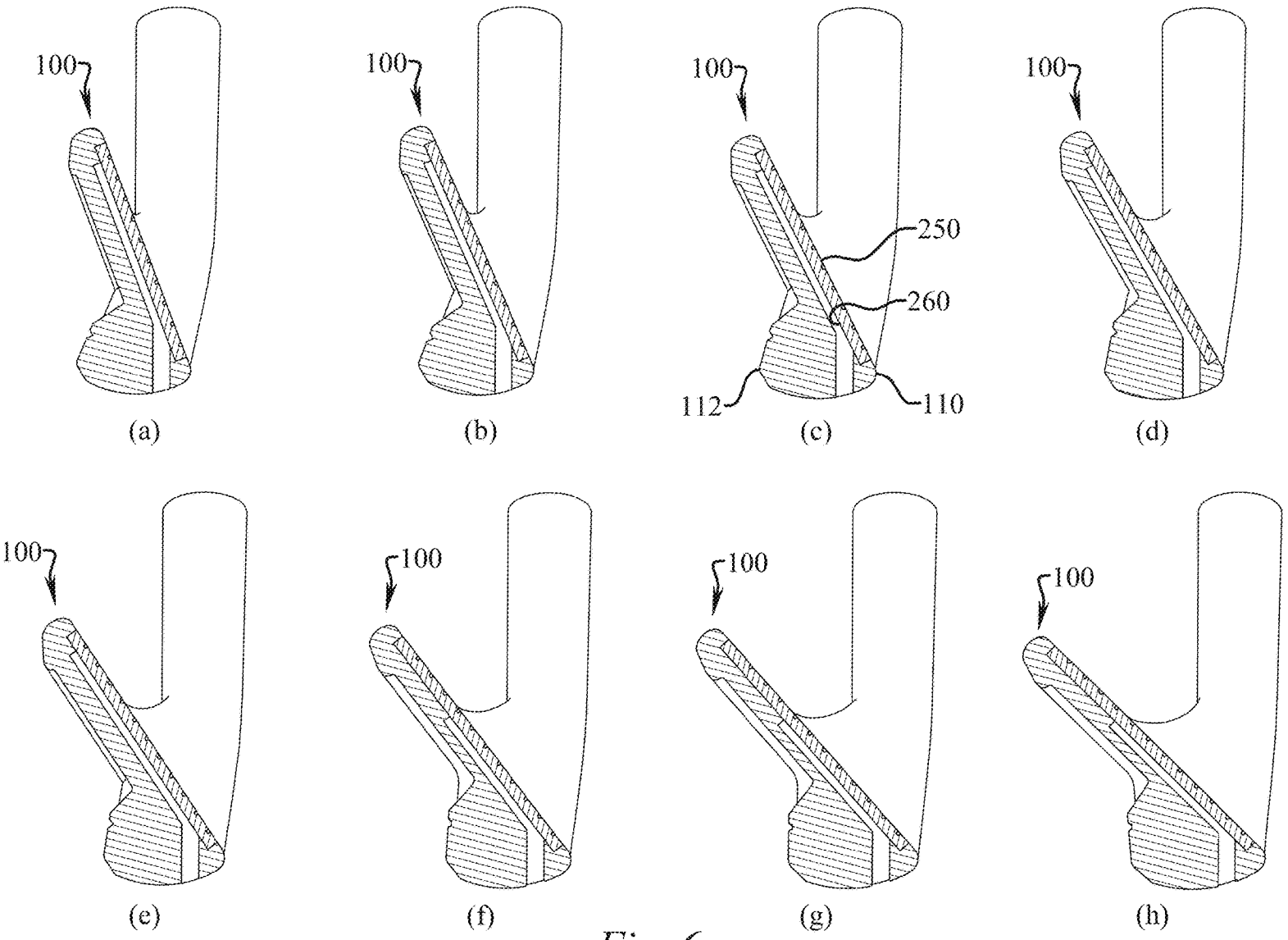
FIG. 6 shows a cross-sectional view taken along section lines (6)-(6) in FIG. 1 of eight iron-type golf club heads of the present invention, not to scale.
Figure 7:
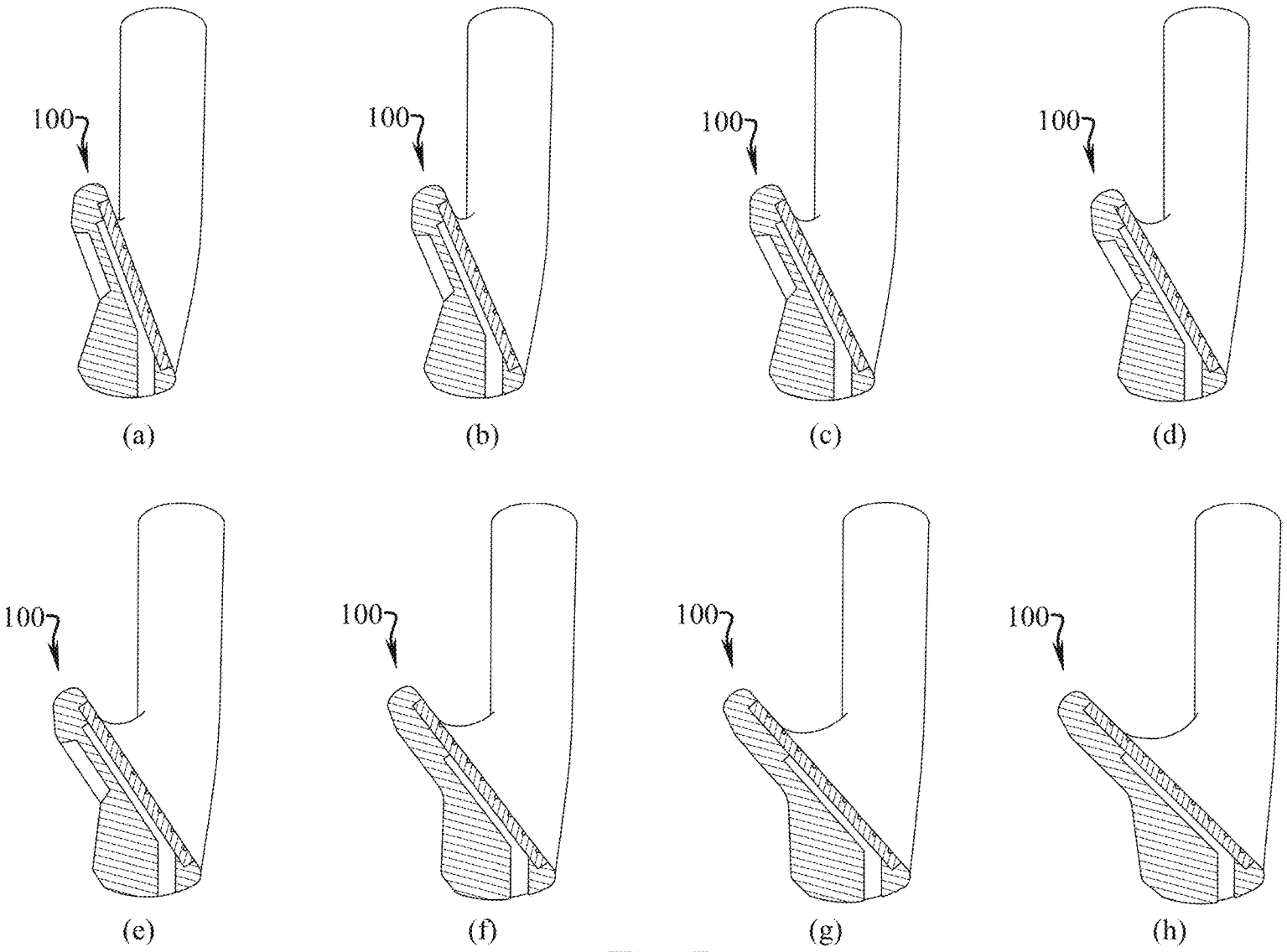
FIG. 7 shows a cross-sectional view taken along section lines (7)-(7) in FIG. 1 of eight iron-type golf club heads of the present invention, not to scale.
Figure 8A:
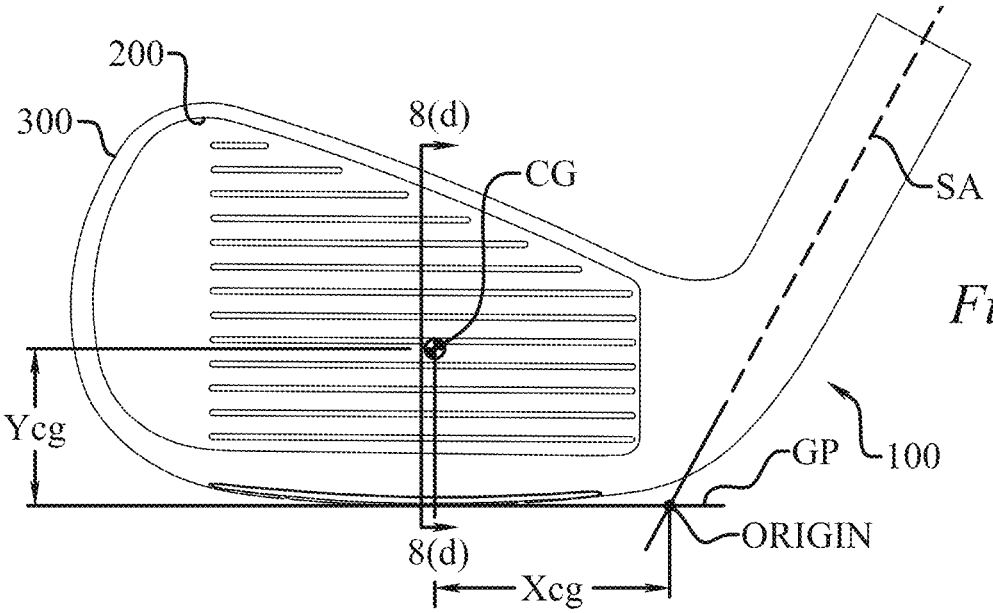
FIG. 8(*a*) shows a front elevation view of an iron-type golf club head of the present invention, not to scale.
Figure 8B:
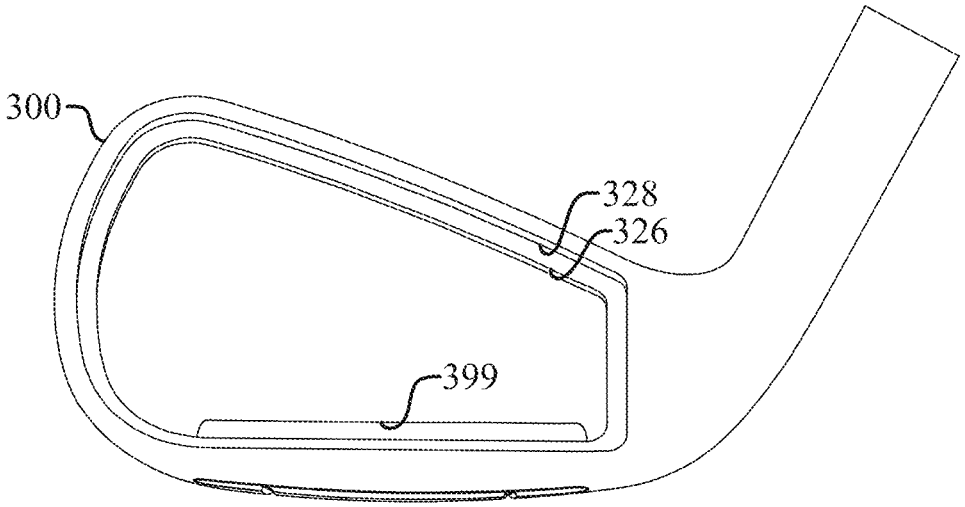
Figure 8C:
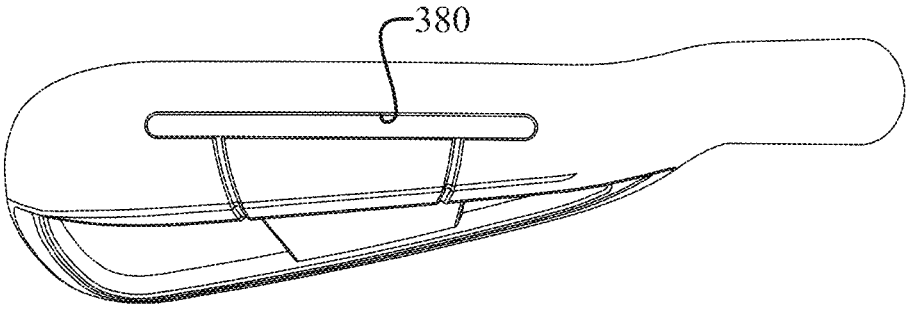
Figure 9A:
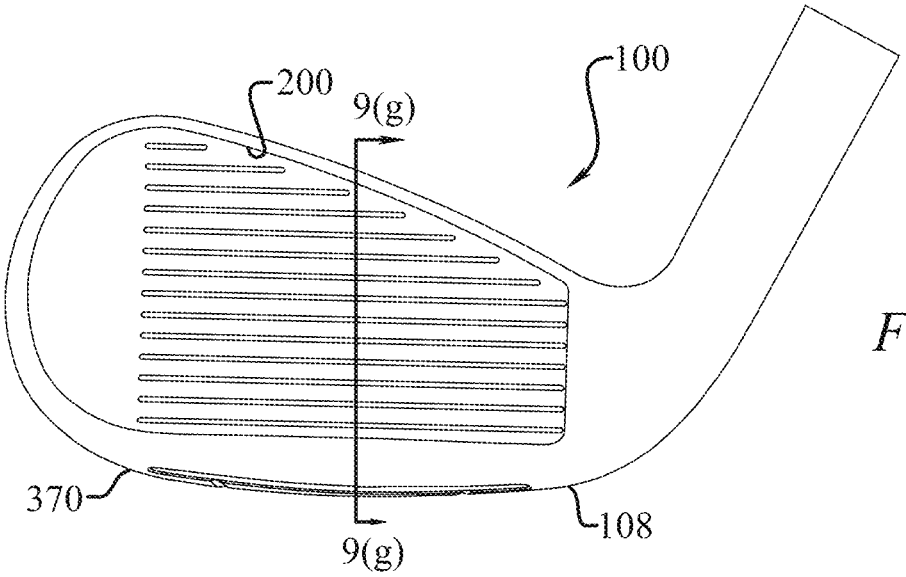
FIG. 9(*a*) shows a front elevation view of an iron-type golf club head of the present invention, not to scale.
Figure 9B:
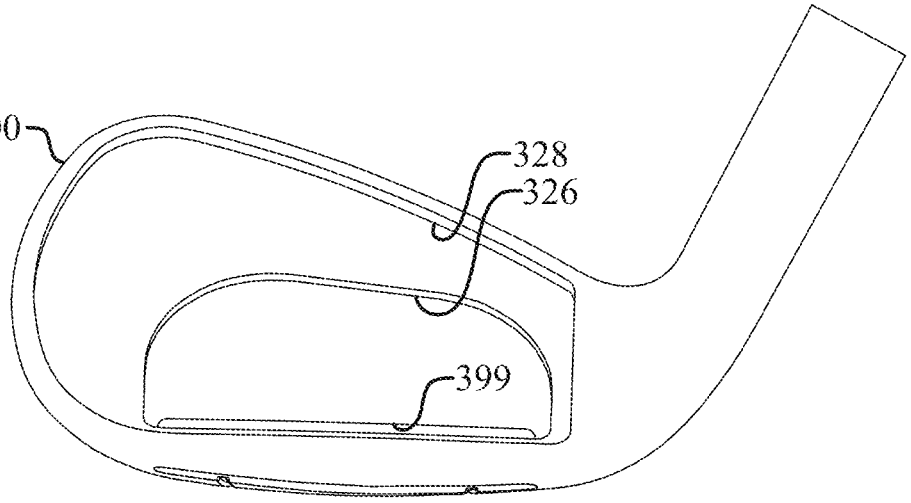
Figure 9C:
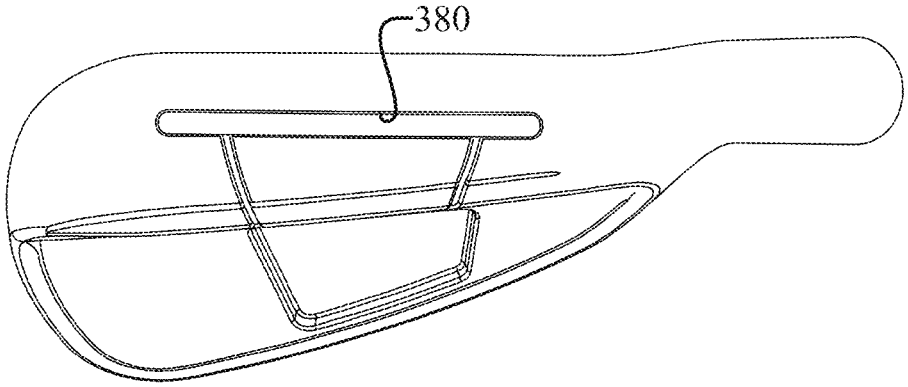
Figure 8D:
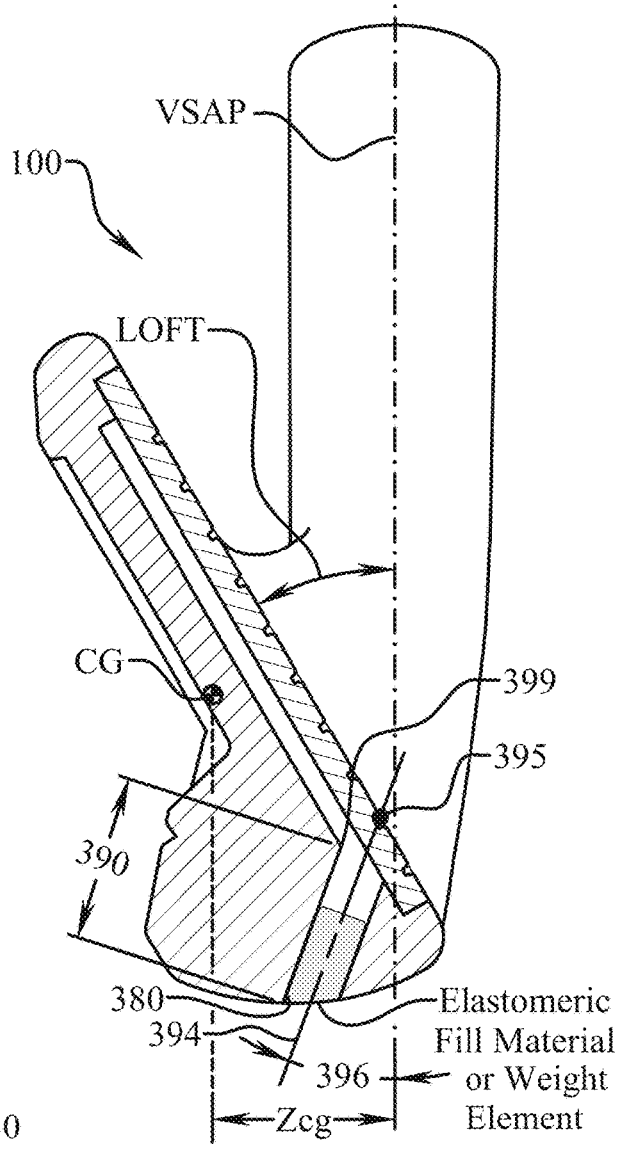
Figure 9D:
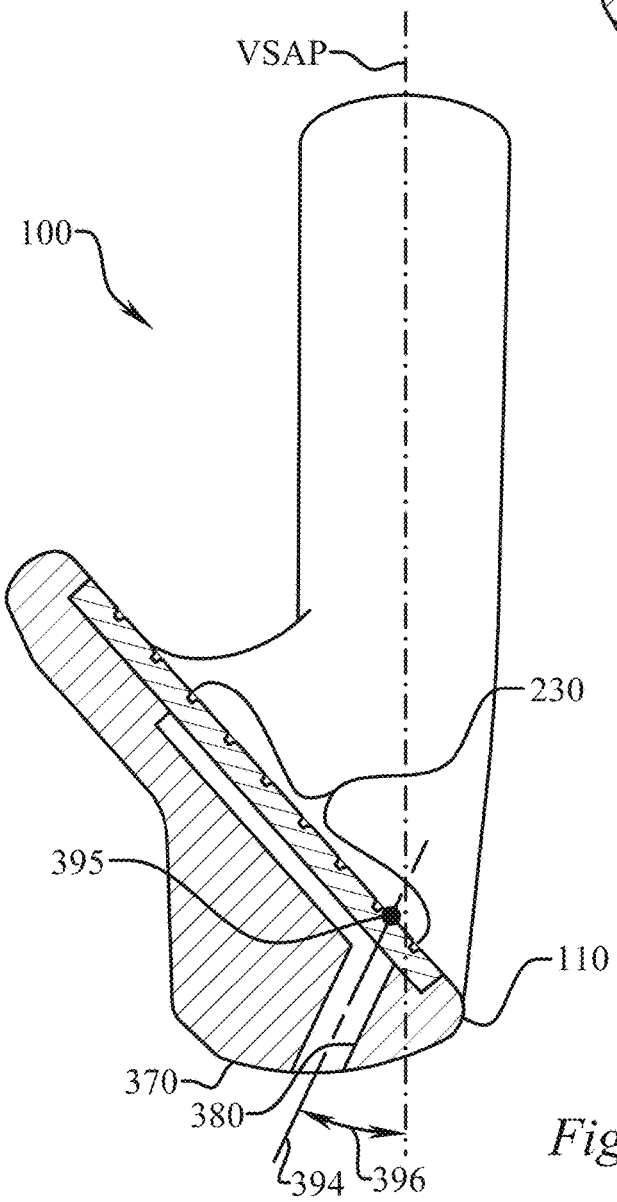
Figure 10:
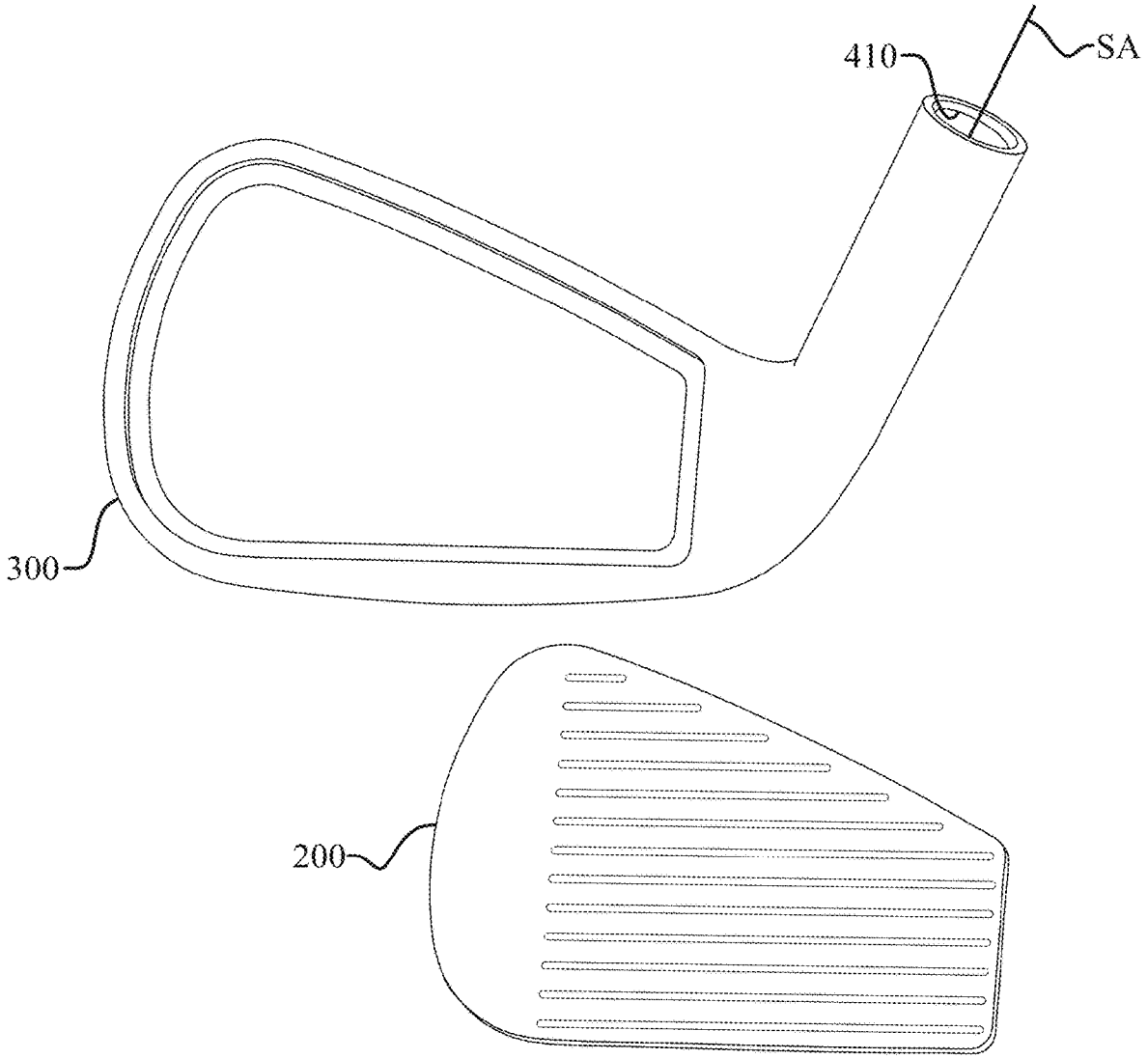
FIG. 10 shows an assembly view of an embodiment of an iron-type golf club head of the present invention with the face removed, not to scale.

In this "set" embodiment the first unsupported face area is at least 70% of the first total face area, and the second unsupported face area is between approximate 20% and approximately 50% of the second total face area. For example, the iron-type golf club head (100) of FIG. 11 may be the first iron-type golf club head of the set having a first unsupported face area is at least 70% of the first total face area; while the iron-type golf club head (100) of FIG. 12 may be the second iron-type golf club head of the set having a second unsupported face area is between approximate 20% and approximately 50% of the second total face area. The shaded area in the iron-type golf club heads of FIG. 3 represents the area within the face support ledge inner perimeter (326) in a plane parallel to the face, which when viewed in light of FIGS. 11 and 12 is the unsupported face portion (230). Thus, another example of a two club set wherein the first unsupported face area is at least 70% of the first total face area, and the second unsupported face area is between approximate 20% and approximately 50% of the second total face area, is the 3-iron of FIG. 3(*a*) for the first iron-type golf club head and the pitching wedge of FIG. 3(*h*) for the second iron-type golf club head. Varying the unsupported face area through a set allows for higher CT's in the low lofted irons to achieve the desired gapping between clubs, while accommodating lower CT's in the higher lofted clubs, which are easier for the average golfer to hit in the middle of the face.

In a further "set" embodiment the second opening/closing moment of inertia is within 20% of the first opening/closing moment of inertia, and the second distance Ycg is within 10% of the first distance Ycg, thereby providing a consistent feel throughout the set and providing a lower piercing trajectory by ensuring that the Ycg distance does not drop too low in the higher lofted club heads. Recall the opening/closing moment of inertial is MOIy. Table 1 illustrates the properties of multiple iron-type golf club heads (100) wherein the 3-iron through the 6-iron all have lofts of 30 degrees or less, while the 7-iron through pitching wedge have lofts of 31 degrees or more. Thus, in the above example in which the 3-iron of FIG. 3(*a*) is the first iron-type golf club head having the first unsupported face area of at least 70% of the first total face area, and the pitching wedge of FIG. 3(*h*) is the second iron type-golf club head having the second unsupported face area between approximate 20% and approximately 50% of the second total face area, Table 1 illustrates that MOIy of the pitching wedge is within 20% of the MOIy of the 3-iron, and the Ycg distance of the pitching wedge is within 10% of the Ycg distance of the 3-iron. Another "set" embodiment narrows the range of unsupported face areas such that the first unsupported face area is at least 80% of the first total face area, and the second unsupported face area is less than 40% of the second total face area.

TABLE 1

| Iron # | 3 | 4 | 5 | 6 | 7 | 8 | 9 | PW |
|---|---|---|---|---|---|---|---|---|
| Loft Angle | 21 | 24 | 27 | 30 | 34 | 38 | 42 | 46 |
| Moment of Inertia (g*cm^2) | | | | | | | | |
| MOIx | 530 | 554 | 577 | 597 | 639 | 681 | 726 | 760 |
| MOIy | 2215 | 2252 | 2288 | 2317 | 2362 | 2427 | 2473 | 2558 |
| Center of Gravity (CG) (inches) | | | | | | | | |

TABLE 1-continued

| Iron # | 3 | 4 | 5 | 6 | 7 | 8 | 9 | PW |
|---|---|---|---|---|---|---|---|---|
| Xcg | 1.146 | 1.146 | 1.151 | 1.150 | 1.164 | 1.162 | 1.172 | 1.182 |
| Ycg | 0.801 | 0.799 | 0.792 | 0.781 | 0.784 | 0.792 | 0.776 | 0.761 |
| Zcg | 0.299 | 0.310 | 0.332 | 0.352 | 0.386 | 0.430 | 0.461 | 0.492 |

Even further embodiments specify how the unsupported face areas are achieved. With reference now to FIGS. 11 and 12, a vertical line is illustrated at the face center, with a second vertical line illustrated 1.0 inches toward the toe and a third vertical line illustrated 1.0 inches toward the heel. This particular embodiment focuses on the face support ledge (320), and specifically the top line support ledge portion (350) and top line ledge width (352), between the second vertical line and the third vertical line. One with skill in the art will recognize how to determine the face center in accordance with current USGA guidelines. In this embodiment the second iron-type golf club head has a second top line ledge width, within the second and third vertical lines, that varies from a minimum second top line ledge width to a maximum second top line ledge width, wherein the maximum second top line ledge width is at least twice the minimum second top line ledge width, which is true for the iron-type golf club head illustrated in FIG. 12. It should be noted that the ledge width is measures on the ledge, parallel to the face, in a direction that is perpendicular to the ledge outer perimeter (328).

A similar embodiment focuses on the face support ledge (320), and specifically the sole support ledge portion (360) and sole ledge width (362), between the second vertical line and the third vertical line. In this embodiment the second iron-type golf club head has a second sole ledge width, within the second and third vertical lines, that varies from a minimum second sole ledge width to a maximum second sole ledge width, wherein the maximum second sole ledge width is at least twice the minimum second sole ledge width, which is also true for the iron-type golf club head illustrated in FIG. 12.

An even further embodiment examines the location of an unsupported face portion centroid (232) on the face striking surface (250), also seen in FIGS. 11-12. Locating the centroid of a simple 2 dimensional surface area is elementary and will not be described herein. In this particular embodiment the unsupported face portion centroid (232) of the second unsupported face area is at an elevation above the horizontal ground plane that is less than the second distance Ycg. Looking again at the above example wherein the pitching wedge is the second iron-type golf club head (100), Table 1 provides an example where the Ycg distance is 0.761 inches. Therefore in this example the elevation above the ground plane of the unsupported face portion centroid (232) of the pitching wedge illustrated in FIG. 12 is less than Ycg distance of 0.761 inches.

In yet a further embodiment the unsupported face portion centroid (232) of the first unsupported face area is at an elevation above the horizontal ground plane that is greater than the first distance Ycg. Looking again at the above example wherein the 3-iron is the first iron-type golf club head (100), Table 1 provides an example where the Ycg distance is 0.801 inches. Therefore in this example the elevation above the ground plane of the unsupported face portion centroid (232) of the 3-iron, assume for the moment that it is the club head illustrated in FIG. 11, is greater than Ycg distance of 0.801 inches.

Yet another "set" embodiment incorporates a third iron-type golf club head. In this embodiment the third iron-type golf club head has a third loft of 27-40 degrees and contains all the elements of the first and the second iron-type golf club heads. In other words, the third iron-type golf club head has a third heel portion, a third toe portion, a third top line portion, a third sole portion, a third leading edge, and a third trailing edge. The third iron-type golf club head includes a third body formed of a third body material and having a third hosel, and has a third face opening, and a third face support ledge. As with the other club heads, the third face support ledge has a third support ledge width separating a third support ledge inner perimeter from a third support ledge outer perimeter, and a third support ledge setback. Similarly, the third hosel has a third bore and a third bore center that defines a third shaft axis which intersects with the horizontal ground plane to define a third origin point. Likewise, a third face is formed of a third face material that is different from the third body material and configured to be received by the third body face opening having a third face perimeter, a third face thickness, a third face striking surface, and a third face rear surface. Further, a portion of the third face rear surface contacts the third face support ledge thereby defining a third supported face portion having a third supported face area; and a portion of the third face rear surface does not contact the third face support ledge thereby defining a third unsupported face portion having a third unsupported face area. The sum of the third supported face area and the third unsupported face area is a third total face area, and the third unsupported face area is less than the first unsupported face area, and the third unsupported face area is greater than the second unsupported face area. Further, the third iron-type golf club head has a third center of gravity located (a) vertically toward the third top line portion of the third iron-type golf club head from the third origin point a third distance Ycg, wherein the third distance Ycg is within 5% of the first distance Ycg; (b) horizontally from the third origin point toward the third toe portion of the third iron-type golf club head a third distance Xcg; and (c) a third distance Zcg from the third origin toward the third trailing edge in a direction generally orthogonal to the vertical direction used to measure the third Ycg distance and generally orthogonal to the horizontal direction used to measure the third Xcg distance. Additionally, the third iron-type golf club head has a third opening/closing moment of inertia about a third vertical axis through the second center of gravity, wherein the third opening/closing moment of inertia is within 15% of the first opening/closing moment of inertia. In one particular 3 club "set" embodiment the first loft is 27 degrees or less, and the second loft is at least 40 degrees.

A further embodiment of the 3 club "set" embodiment just described has a first unsupported face area is at least 80% of the first total face area, a second unsupported face area is less than 40% of the second total face area, and a third unsupported face area is between approximate 20% and approximately 50% of the third total face area. In yet another embodiment the unsupported face portion centroid of the second unsupported face area is at an elevation above the horizontal ground plane that is less than the second distance Ycg, and an unsupported face portion centroid of the first unsupported face area is at an elevation above the horizontal ground plane that is greater than the first distance Ycg.

Alternative "set" embodiments introduce the sole channel (300) previous disclosed into the first iron-type golf club head and the second iron-type golf club head. Specifically, the first body (300) includes a first body sole portion (108) having a first sole channel (380) extending from the exterior of the first body sole portion (108) toward the first face (200), wherein the first sole channel (380) has a first channel leading edge (382), a first channel trailing edge (384), a first channel width (386), a first channel length (388), a first channel depth (390), a first channel leading edge setback (392), and a first channel axis (394) establishing a first channel angle (396) from the vertical. Likewise, the second body includes a second body sole portion having a second sole channel extending from the exterior of the second body sole portion toward the second face, wherein the second sole channel has a second channel leading edge, a second channel trailing edge, a second channel width, a second channel length, a second channel depth, a second channel leading edge setback, and a second channel axis establishing a second channel angle from the vertical. Another sole channel "set" embodiment is characterized by a portion of the first sole channel (380) that has the first channel axis (394) intersecting the first face (200) and the first channel angle (396) that is at least 20% of the first loft. A further embodiment specifies that a portion of the first sole channel (380) has the first channel axis (394) intersecting the first unsupported face portion (230) and the first channel angle (396) is at least 20% of the first loft.

A further sole channel "set" embodiment has a portion of the first sole channel (380) that extends through the first body sole portion (108) creating a first passageway (398) from the exterior of the first body sole portion (108) to a first termination opening (399) behind the first unsupported face portion (230). Taking this embodiment a step further, another embodiment has at least 50% of the first channel length (388) that extends through the first body sole portion (108) creating a first passageway (398) from the exterior of the first body sole portion (108) to a first termination opening (399) behind the first unsupported face portion (230). Further embodiments incorporate the same design characteristics into the second iron-type golf club head. For example, a first such embodiment has a portion of the second sole channel with a second channel axis intersecting the second face and a second channel angle that is at least 20% of the second loft. A second such embodiment has a portion of the second sole channel with a second channel axis intersecting the second unsupported face portion and wherein the second channel angle is at least 20% of the second loft. A third such embodiment incorporates a portion of the second sole channel extending through the second body sole portion and creating a second passageway from the exterior of the second body sole portion to a second termination opening behind the second unsupported face portion. A fourth such embodiment has at least 50% of the second channel length extending through the second body sole portion to create a second passageway from the exterior of the second body sole portion to a second termination opening behind the second unsupported face portion. Similar embodiments are present for the third iron-type golf club head.

Further embodiments incorporate a sole channel in the first and second iron-type golf club heads, and the first, second, and third iron-type golf club heads. For example, in one such example a portion of the first sole channel (380) has the first channel axis (394) intersecting the first face (200) and the first channel angle (396) is at least 20% of the first loft, and a portion of the second sole channel has the second channel axis intersecting the second face and the second channel angle is at least 20% of the second loft. Yet another embodiment has a portion of the first sole channel (380) with a first channel axis (394) intersecting the first face (200) and the first channel angle (396) is at least 50% of the first loft; and a portion of the second sole channel with a second channel axis intersecting the second face and the second channel angle is at least 50% of the second loft.

The iron-type golf club head (100) may be of solid (i.e., "blades" and "musclebacks"), hollow, cavity back, or other construction. In certain embodiments the iron-type golf club head (100) include a face (200) attached to the body (300). The face (200) may be formed of tool steel alloys such as JIS SKD61 and AISI H13, forged maraging steel, maraging stainless steel, or precipitation-hardened (PH) stainless steel. In another embodiment, a maraging stainless steel C455 is utilized to form the face (200), while in another the face (200) is formed of a precipitation hardened stainless steel such as 17-4, 15-5, or 17-7. In further embodiments the face (200) is forged by hot press forging using any of the described materials in a progressive series of dies. After forging, the face (200) may be subjected to heat-treatment. In some embodiments, the body (300) is made from 17-4 steel, while other embodiments incorporate carbon steel (e.g., 1020, 1025, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50), and N60 stainless steel (e.g., 410 stainless steel). In addition to those noted above, some examples of metals and metal alloys that may be used to form the face (200) include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys. In still other embodiments, the body (300) and/or face (200) are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety. The body (300) may include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

In some embodiments the sole channel (380) may left unfilled, however further embodiments include a filler material added into the sole channel (380). One or more fillers may be added to achieve desired performance objectives, including desired changes to the sound and feel of the club head that may be obtained by damping vibrations that occur when the club head strikes a golf ball. Examples of materials that may be suitable for use as a filler to be placed into a sole channel (380), without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes;

polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-1 05™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some embodiments, a solid filler material may be press-fit or adhesively bonded into the sole channel (380). In other embodiments, a filler material may poured, injected, or otherwise inserted into the sole channel (380) and allowed to cure in place, forming a sufficiently hardened or resilient outer surface. In still other embodiments, a filler material may be placed into the sole channel (380) and sealed in place with a resilient cap or other structure formed of a metal, metal alloy, metallic, composite, hard plastic, resilient elastomeric, or other suitable material. In some embodiments, the portion of the filler or cap that is exposed within the sole channel (380) has a generally convex shape and is disposed within the channel such that the lowermost portion of the filler or cap is displaced by a gap below the lowermost surface of the immediately adjacent portions of the body (300). The gap is preferably sufficiently large to prevent excessive wear and tear on the filler or cap that is exposed within the sole channel (380) due to striking the ground or other objects.

Those skilled in the art know that the characteristic time, often referred to as the CT, value of a golf club head is limited by the equipment rules of the United States Golf Association (USGA). As used herein, the terms "coefficient of restitution," "COR," "relative coefficient of restitution," "relative COR," "characteristic time," and "CT" are defined according to the following. The coefficient of restitution (COR) of an iron clubhead is measured according to procedures described by the USGA Rules of Golf as specified in the "Interim Procedure for Measuring the Coefficient of Restitution of an Iron Clubhead Relative to a Baseline Plate," Revision 1.2, Nov. 30, 2005 (hereinafter "the USGA COR Procedure"). Specifically, a COR value for a baseline calibration plate is first determined, then a COR value for an iron clubhead is determined using golf balls from the same dozen(s) used in the baseline plate calibration. The measured calibration plate COR value is then subtracted from the measured iron clubhead COR to obtain the "relative COR" of the iron clubhead. To illustrate by way of an example: following the USGA COR Procedure, a given set of golf balls may produce a measured COR value for a baseline calibration plate of 0.845. Using the same set of golf balls, an iron clubhead may produce a measured COR value of 0.825. In this example, the relative COR for the iron clubhead is 0.825−0.845=−0.020. This iron clubhead has a COR that is 0.020 lower than the COR of the baseline calibration plate, or a relative COR of −0.020.

The characteristic time (CT) is the contact time between a metal mass attached to a pendulum that strikes the face center of the golf club head at a low speed under conditions prescribed by the USGA club conformance standards. As used herein, the term "volume" when used to refer to a golf clubhead refers to a clubhead volume measured according to the procedure described in Section 5.0 of the "Procedure For Measuring the Clubhead Size of Wood Clubs," Revision 1.0.0, published Nov. 21, 2003 by the United States Golf Association (the USGA) and R&A Rules Limited. The foregoing procedure includes submerging a clubhead in a large volume container of water. In the case of a volume measurement of a hollow iron type clubhead, any holes or openings in the walls of the clubhead are to be covered or otherwise sealed prior to lowering the clubhead into the water.

All the ratios used in defining embodiments of the present invention involve the discovery of unique relationships among key club head engineering variables that are inconsistent with merely striving to obtain as high of a CT as possible using conventional golf club head design wisdom. Numerous alterations, modifications, and variations of the preferred embodiments disclosed herein will be apparent to those skilled in the art and they are all anticipated and contemplated to be within the spirit and scope of the instant invention. Further, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

We claim:

1. An iron-type golf club head, comprising:

a heel portion, a toe portion, a top line portion, a sole portion, a leading edge, a trailing edge, a face oriented at a loft of 30 degrees or less and having a face thickness, a face striking surface, and a face rear surface, and a hosel having a bore and a bore center that defines a shaft axis which intersects with a horizontal ground plane to define an origin point, and defines a shaft axis plane, wherein:

i) a portion of the face rear surface defines a closed void within the club head so that majority of the face is not supported by the heel portion, toe portion, top line portion, and sole portion;

ii) a passageway is accessible from an exterior of the club head and in communication with the closed void;

iii) the iron-type golf club head has a center of gravity located:

(a) vertically toward the top line portion from the origin point a distance Ycg that is no more than 0.801";

(b) horizontally from the origin point toward the toe portion a distance Xcg;

(c) horizontally from the origin point a distance Zcg toward the trailing edge in a direction generally orthogonal to the vertical direction used to measure the Ycg distance and generally orthogonal to the horizontal direction used to measure the Xcg distance, wherein the Zcg distance is no more than 0.492";

iv) the iron-type golf club head has an opening/closing moment of inertia about a vertical axis through the center of gravity, and a lofting/delofting moment of inertia about a horizontal axis through the center of gravity that is no more than 760 g*cm^2;

v) in a horizontal section parallel to the horizontal ground plane and passing through the center of gravity, the closed void is located between the center of gravity and the face, with no portion of the closed void within the horizontal section extending behind the center of gravity, and a portion of the closed void is located at an elevation above the horizontal ground plane that is greater than the Ycg distance; and vi) wherein each vertical cross-section through the passageway establishes a passageway axis, at least a portion of the passageway axis intersects the face at an axis-to-face intersection point and intersects the shaft axis plane, and the passageway axis has a passageway angle from vertical that is at least 50% of the loft.

2. The iron-type golf club head of claim 1, wherein at least one of the passageway and the closed void contain an elastomer.

3. The iron-type golf club head of claim 1, wherein the portion of the face in front of the closed void and not supported by the heel portion, toe portion, top line portion, and sole portion, defines an unsupported face area having an unsupported face portion centroid located at an elevation above the horizontal ground plane that is greater than the Ycg distance.

4. The iron-type golf club head of claim 3, wherein a portion of the face has a face thickness is less than 2.0 mm.

5. The iron-type golf club head of claim 4, wherein the passageway has a passageway width and a portion of the passageway width is greater than the face thickness.

6. The iron-type golf club head of claim 4, wherein a portion of the closed void has a void depth that is less than the face thickness.

7. The iron-type golf club head of claim 4, wherein the Zcg distance is no more than 0.430" and the opening/closing moment of inertia is no more than 2558 g*cm^2.

8. The iron-type golf club head of claim 4, wherein an elevation of the axis-to-face intersection point is less than the Ycg distance.

9. The iron-type golf club head of claim 4, wherein the face includes a face insert formed of a face material and attached to a body portion formed of a body material and including the hosel and at least a portion of the heel portion, the toe portion, and the sole portion, wherein the body material is different from the face material, and the face material has a yield strength of at least 1400 MPa and greater than the body material.

10. An iron-type golf club head, comprising:

a heel portion, a toe portion, a top line portion, a sole portion, a leading edge, a trailing edge, a face oriented at a loft and having a face thickness, a face striking surface, and a face rear surface, and a hosel having a bore and a bore center that defines a shaft axis which intersects with a horizontal ground plane to define an origin point, and defines a shaft axis plane, wherein:

i) a portion of the face rear surface defines a closed void within the club head so that majority of the face is not supported by the heel portion, toe portion, top line portion, and sole portion;

ii) a passageway is accessible from an exterior of the club head and in communication with the closed void, wherein at least one of the passageway and the closed void contain an elastomer;

iii) the iron-type golf club head has a center of gravity located:

(a) vertically toward the top line portion from the origin point a distance Ycg that is no more than 0.801";

(b) horizontally from the origin point toward the toe portion a distance Xcg;

(c) horizontally from the origin point a distance Zcg toward the trailing edge in a direction generally orthogonal to the vertical direction used to measure the Ycg distance and generally orthogonal to the horizontal direction used to measure the Xcg distance, wherein the Zcg distance is no more than 0.492";

iv) at least one body weight element secured to the exterior of the golf club head and in communication with the closed void;

v) the face includes a face insert formed of a face material and attached to a body portion formed of a body material different from the face material, and a portion of face has a face thickness of less than 2.0 mm;

vi) the iron-type golf club head has an opening/closing moment of inertia about a vertical axis through the center of gravity, and a lofting/delofting moment of inertia about a horizontal axis through the center of gravity that is no more than 760 g*cm^2;

vii) a portion of the closed void is located at an elevation above the horizontal ground plane that is greater than the Ycg distance, and the portion of the face in front of the closed void and not supported by the heel portion, toe portion, top line portion, and sole portion, defines an unsupported face area having an unsupported face portion centroid located at an elevation above the horizontal ground plane that is greater than the Ycg distance; and viii) wherein each vertical cross-section through the passageway establishes a passageway axis, at least a portion of the passageway axis intersects the face at an axis-to-face intersection point and intersects the shaft axis plane, and an elevation of the axis-to-face intersection point is less than the Ycg distance.

11. The iron-type golf club head of claim 10, wherein the passageway has a passageway width and a portion of the passageway width is greater than the face thickness.

12. The iron-type golf club head of claim 10, wherein the Zcg distance is no more than 0.430" and the opening/closing moment of inertia is no more than 2558 g*cm^2.

13. The iron-type golf club head of claim 10, wherein in a horizontal section parallel to the horizontal ground plane and passing through the center of gravity, the closed void is located between the center of gravity and the face, with no portion of the closed void within the horizontal section extending behind the center of gravity, and a portion of the closed void is located at an elevation above the horizontal ground plane that is greater than the Ycg distance.

14. An iron-type golf club head, comprising:

a heel portion, a toe portion, a top line portion, a sole portion, a leading edge, a trailing edge, a face oriented at a loft of 30 degrees or less and having a face thickness, a face striking surface, and a face rear surface, and a hosel having a bore and a bore center that defines a shaft axis which intersects with a horizontal ground plane to define an origin point, and defines a shaft axis plane, wherein:

i) a portion of the face rear surface defines a closed void within the club head so that majority of the face is not supported by the heel portion, toe portion, top line portion, and sole portion;

ii) a passageway is accessible from an exterior of the club head and in communication with the closed void;

iii) the iron-type golf club head has a center of gravity located:

(a) vertically toward the top line portion from the origin point a distance Ycg that is no more than 0.801";

(b) horizontally from the origin point toward the toe portion a distance Xcg;

(c) horizontally from the origin point a distance Zcg toward the trailing edge in a direction generally orthogonal to the vertical direction used to measure the Ycg distance and generally orthogonal to the horizontal direction used to measure the Xcg distance, wherein the Zcg distance is no more than 0.492";

iv) the iron-type golf club head has an opening/closing moment of inertia about a vertical axis through the center of gravity, and a lofting/delofting moment of inertia about a horizontal axis through the center of gravity that is no more than 760 g*cm^2;

v) in a horizontal section parallel to the horizontal ground plane and passing through the center of gravity, the closed void is located between the center of gravity and the face, with no portion of the closed void within the horizontal section extending behind the center of gravity, and a portion of the closed void is located at an elevation above the horizontal ground plane that is greater than the Ycg distance; and vi) wherein each vertical cross-section through the passageway establishes a passageway axis, at least a portion of the passageway axis intersects the face at an axis-to-face intersection point and intersects the shaft axis plane, and an elevation of the axis-to-face intersection point is less than the Ycg distance.

15. The iron-type golf club head of claim 14, wherein at least one of the passageway and the closed void contain an elastomer, a portion of the face has a face thickness is less than 2.0 mm, and the portion of the face in front of the closed void and not supported by the heel portion, toe portion, top line portion, and sole portion, defines an unsupported face area having an unsupported face portion centroid located at an elevation above the horizontal ground plane that is greater than the Ycg distance.

16. The iron-type golf club head of claim 15, wherein the passageway has a passageway width and a portion of the passageway width is greater than the face thickness.

17. The iron-type golf club head of claim 15, wherein a portion of the closed void has a void depth that is less than the face thickness.

18. The iron-type golf club head of claim 15, wherein the Zcg distance is no more than 0.430" and the opening/closing moment of inertia is no more than 2558 g*cm^2.

19. The iron-type golf club head of claim 15, wherein the passageway axis has a passageway angle from vertical that is at least 50% of the loft.

* * * * *